US008198526B2

(12) United States Patent
Izen et al.

(10) Patent No.: US 8,198,526 B2
(45) Date of Patent: Jun. 12, 2012

(54) METHODS AND APPARATUS FOR INPUT DEVICES FOR INSTRUMENTS AND/OR GAME CONTROLLERS

(75) Inventors: Mark Izen, Chestnut Hill, MA (US); Craig Small, Framingham, MA (US); Stephen Paul Webster, Oakville (CA)

(73) Assignee: 745 LLC, Boston, MA (US)

( * ) Notice: Subject to any disclaimer, the term of this patent is extended or adjusted under 35 U.S.C. 154(b) by 221 days.

(21) Appl. No.: 12/705,308

(22) Filed: Feb. 12, 2010

(65) Prior Publication Data

US 2010/0261513 A1 Oct. 14, 2010

Related U.S. Application Data

(60) Provisional application No. 61/168,930, filed on Apr. 13, 2009.

(51) Int. Cl.
*G10H 1/32* (2006.01)

(52) U.S. Cl. ..... 84/743

(58) Field of Classification Search ..... 84/743
See application file for complete search history.

(56) References Cited

U.S. PATENT DOCUMENTS

| | | | | |
|---|---|---|---|---|
| 4,759,219 | A | | 7/1988 | Cobb et al. |
| 4,909,117 | A | | 3/1990 | Reiling et al. |
| 4,980,519 | A | | 12/1990 | Mathews |
| 5,017,770 | A | | 5/1991 | Sigalov |
| 5,045,687 | A | | 9/1991 | Gurner |
| 5,056,783 | A | | 10/1991 | Matcovich et al. |
| 5,058,480 | A | | 10/1991 | Suzuki et al. |
| 5,062,341 | A | * | 11/1991 | Reiling et al. ..... 84/702 |
| 5,157,213 | A | | 10/1992 | Kashio et al. |
| 5,170,002 | A | | 12/1992 | Suzuki et al. |
| 5,177,311 | A | | 1/1993 | Suzuki et al. |
| 5,286,908 | A | | 2/1994 | Jungleib |
| 5,290,964 | A | | 3/1994 | Hiyoshi et al. |
| 5,414,256 | A | | 5/1995 | Gurner et al. |
| 5,438,529 | A | | 8/1995 | Rosenberg et al. |
| 5,442,168 | A | | 8/1995 | Gurner et al. |
| 5,448,008 | A | | 9/1995 | Okamoto et al. |
| 5,459,312 | A | | 10/1995 | Gurner et al. |
| 5,475,214 | A | | 12/1995 | DeFranco et al. |
| 5,920,024 | A | | 7/1999 | Moore |

(Continued)

FOREIGN PATENT DOCUMENTS

GB 2183076 A 5/1987

(Continued)

OTHER PUBLICATIONS

International Search Report and Written Opinion for International Application Serial No. PCT/US2010/000963 mailed Sep. 14, 2010.
Photo Laval virtual festival, photo virtual drums 16, http://www.virtual-drums.com/photos.php/virtual-drums-laval-virtual-016/ downloaded Nov. 9, 2010.

(Continued)

*Primary Examiner* — Jianchun Qin
(74) *Attorney, Agent, or Firm* — Wolf, Greenfield & Sacks, P.C.

(57) ABSTRACT

Electronic game components are described. The electronic game components may define radiation striking zones in which user strikes may be detected. In response to detecting the strikes, control signals for an audio generator or gaming console may be generated. The electronic game components may be used to simulate percussive instruments, with the radiation striking zones corresponding to percussive components of the simulated percussive instrument.

37 Claims, 11 Drawing Sheets

U.S. PATENT DOCUMENTS

| | | | | |
|---|---|---|---|---|
| 5,990,409 | A | 11/1999 | Takahashi et al. | |
| 6,198,034 | B1 | 3/2001 | Beach et al. | |
| 6,390,923 | B1 | 5/2002 | Yoshitomi et al. | |
| 6,492,775 | B2 | 12/2002 | Klotz et al. | |
| 6,495,748 | B1 | 12/2002 | Wang et al. | |
| 6,501,012 | B1 | 12/2002 | Toba et al. | |
| 6,685,480 | B2 | 2/2004 | Nishimoto et al. | |
| 6,905,413 | B1 | 6/2005 | Terao et al. | |
| 6,919,503 | B2 * | 7/2005 | Nishitani et al. | 84/633 |
| 6,960,715 | B2 | 11/2005 | Riopelle | |
| 7,456,815 | B2 | 11/2008 | Reime | |
| 7,504,577 | B2 | 3/2009 | Riopelle | |
| 2002/0026866 | A1 | 3/2002 | Nishitani et al. | |
| 2003/0070537 | A1 | 4/2003 | Nishitani et al. | |
| 2004/0200338 | A1 | 10/2004 | Pangrle | |
| 2005/0223330 | A1 | 10/2005 | Riopelle | |
| 2006/0060068 | A1 | 3/2006 | Hwang et al. | |
| 2006/0084218 | A1 | 4/2006 | Lee et al. | |
| 2006/0084516 | A1 | 4/2006 | Eyestone et al. | |
| 2007/0265104 | A1 | 11/2007 | Haga et al. | |
| 2007/0270217 | A1 | 11/2007 | Rabin | |
| 2008/0300055 | A1 * | 12/2008 | Lutnick et al. | 463/39 |
| 2008/0311969 | A1 | 12/2008 | Kay et al. | |
| 2008/0318677 | A1 | 12/2008 | Ohta | |
| 2009/0075711 | A1 | 3/2009 | Brosius et al. | |
| 2009/0088249 | A1 | 4/2009 | Kay et al. | |
| 2010/0009746 | A1 * | 1/2010 | Raymond et al. | 463/31 |
| 2011/0090487 | A1 * | 4/2011 | Schmidt et al. | 356/152.1 |

FOREIGN PATENT DOCUMENTS

| | | | |
|---|---|---|---|
| GB | 2183889 | A | 6/1987 |
| GB | 2403338 | A | 12/2004 |
| JP | 2006053167 | A | 2/2006 |
| JP | 3933057 | B2 | 6/2007 |
| KR | 1020080098991 | A | 11/2008 |
| WO | WO 89/10611 | A1 | 11/1989 |
| WO | WO 2004060509 | A2 | 7/2004 |

OTHER PUBLICATIONS

Photo Virtual drums, video games mode (a la Dance Dance revolution), http://www.virtual-drums.com/photos.php/screenshots-virtual-drums-3/ downloaded Nov. 9, 2010.

Donkey Konga Score: 7.0 / 10, Omni, Oct. 14, 2004, http://www.armchairempire.com/Reviews/GameCube/donkey-konga.htm downloaded Nov. 9, 2010.

WTS:Taiko no Tatsujin Wii Drum!, Zahne, Dec. 30, 2008, http://forums.gameaxis.com/showthread.php?p=21562595 downloaded Nov. 9, 2010.

John Meadowcroft Professional Portfolio, Monthly Archives: Nov. 2008, p. 5, http://jonnymeddy.wordpress.com/2008/11/ downloaded Nov. 9, 2010.

Playstation 2, http://www.toysnjoys.com/psx2games_d.html, downloaded Nov. 9, 2010.

Computer to Day: V-Beat Air Drum 'Motion Sensitive' Electronic Drumsticks Hit Firebox [Virtual Drum Kit—A Great Frustration Buster], Mar. 13, 2009, http://computer-2-day.blogspot.com/2009/03/v-beat-air-drum-motion-sensitive.html downloaded Nov. 9, 2010.

V-Beat Drumsticks: Drumming in the air tonight?, http://www.firebox.com/product/2023/V-Beat-Drumsticks?via=cat downloaded Nov. 9, 2010.

Kohler, C., Hands on: *Let's Tap* Not Entirely Stupid, Oct. 10, 2008, http://www.wired.com/gamelife/2008/10/hands-on-lets-t/ downloaded Nov. 9, 2010.

We Rock: Drum King (Wii), 505 Games, ARC System Works, http://www.videogamer.com/wii/we_rock_drum_king/screenshot-29.html, downloaded Nov. 9, 2010.

XaviXPORT Advertisement, launched Aug. 2004, http://www.xavix.com/products/port.html, downloaded Nov. 9, 2010.

Beatmania Review for the PS2, http://www.gamerevolution.com/review/ps2/beatmania, downloaded Nov. 9, 2010.

Guitarhero.Com Community Guitarhero.Com Register, p. 2, http://worldtour.guitarhero.com/us/, downloaded Nov. 12, 2010.

GunCon, From Wikipedia, the free encyclopedia, http://en.wikipedia.org/wiki/GunCon, pp. 1-4, downloaded Nov. 12, 2010.

Jubeat, From Wikipedia, the free encyclopedia, http://en.wikipedia.org/wiki/Jubeat, p. 1 of 1, downloaded Nov. 12, 2010.

* cited by examiner

METHODS AND APPARATUS FOR INPUT DEVICES FOR INSTRUMENTS AND/OR GAME CONTROLLERS

RELATED APPLICATIONS

The present application claims the benefit under 35 U.S.C. §119(e) of U.S. Provisional Patent Application Ser. No. 61/168,930, filed on Apr. 13, 2009, and entitled "METHODS AND APPARATUS FOR INPUT DEVICES FOR INSTRUMENT AND/OR GAME CONTROLLERS," which application is hereby incorporated herein by reference in its entirety.

BACKGROUND

1. Field

The technology described herein relates to electronic game components simulating percussive instruments.

2. Related Art

Conventional percussive instruments include a percussive component that is struck by a component (e.g., a stick, mallet, etc.) or a user's hand. One example of a conventional percussive instrument is a drum. A conventional drum kit includes drum heads that are physically struck with drumsticks held by a drummer. The sound produced by a drum when struck depends on the design of the drumhead, including the size, shape, and material of the drumhead.

BRIEF SUMMARY

According to one aspect of the present invention, an electronic game component is provided that simulates a percussion instrument. The percussion instrument comprises a plurality of percussion components, and the electronic game component comprises at least one base module defining a plurality of radiation striking zones each corresponding to one of the plurality of percussion components. The plurality of radiation striking zones are arranged and sized to simulate the plurality of percussion components. The electronic game component further comprises processing circuitry that, in response to detection of a strike by at least one striker in any of the plurality of radiation striking zones, generates at least one signal indicating in which of the plurality of radiation striking zones the strike was detected.

According to another aspect of the present invention, an electronic game component is provided that simulates a percussion instrument comprising a plurality of percussion components. The electronic game component comprises at least one base module defining a plurality of radiation striking zones each corresponding to one of the plurality of percussion components, and at least one striker comprising at least one sensor that senses when the at least one striker has been swung with a threshold value of a characteristic of motion. The electronic game component further comprises at least one detector that detects a strike by the at least one striker in any of the plurality of radiation striking zones, wherein the at least one detector detects a strike by the at least one striker in any of the plurality of striking zones only when the at least one sensor senses that the at least one striker has been swung with the threshold value of the characteristic of motion. The electronic game component further comprises processing circuitry that generates at least one control signal indicating in which of the plurality of radiation striking zones the strike was detected.

According to another aspect of the present invention, an electronic game system is provided that simulates a percussion instrument comprising a plurality of percussion components. The electronic game system comprises at least one base module defining a plurality of radiation striking zones each corresponding to one of the plurality of percussion components and first and second strikers for striking the plurality of radiation striking zones. The electronic game system further comprises processing circuitry configured to receive at least one detection signal indicating a strike by either of the first and second strikers in any of the plurality of radiation striking zones. The processing circuitry is further configured to identify which of the first and second strikers was used in the strike and generate at least one control signal indicating in which of the plurality of radiation striking zones the strike was detected and by which of the first and second strikers.

According to another aspect of the present invention, an electronic device controller is provided. The electronic device controller comprises a first stick comprising a first acceleration sensor configured to sense acceleration of the first stick and a first signal transmitter configured to transmit a first signal identifying the first stick in response to the first acceleration sensor sensing an acceleration of the first stick above a first threshold value. The electronic device controller further comprises a second stick comprising a second acceleration sensor configured to sense acceleration of the second stick and a second signal transmitter configured to transmit a second signal identifying the second stick in response to the second acceleration sensor sensing an acceleration of the second stick above a second threshold value.

According to another aspect of the present invention, a drum kit console is provided that simulates a drum kit comprising a plurality of percussion components. The drum kit console comprises first and second sticks, at least one base module defining a plurality of radiation striking zones each corresponding to one of the plurality of percussion components, and at least one detector that detects a strike by the first and/or second stick in one of the plurality of radiation striking zones. The drum kit console further comprises processing circuitry that generates at least one control signal indicating in which of the plurality of radiation striking zones the strike was detected. The plurality of radiation striking zones expand outwardly from the at least one base module so that at a distance from the at least one base module the plurality of radiation striking zones collectively define a surface area greater than a surface area of the base module.

Other aspects of the present invention will be evident from the following detailed description.

BRIEF DESCRIPTION OF DRAWINGS

Description of various aspects and embodiments of the invention will be given by reference to the following drawings. The drawings are not necessarily drawn to scale. Each identical or nearly identical component illustrated in multiple drawings is represented by a like numeral. For purposes of clarity, not every component may be labeled in every drawing.

DETAILED DESCRIPTION

Figure 1A:
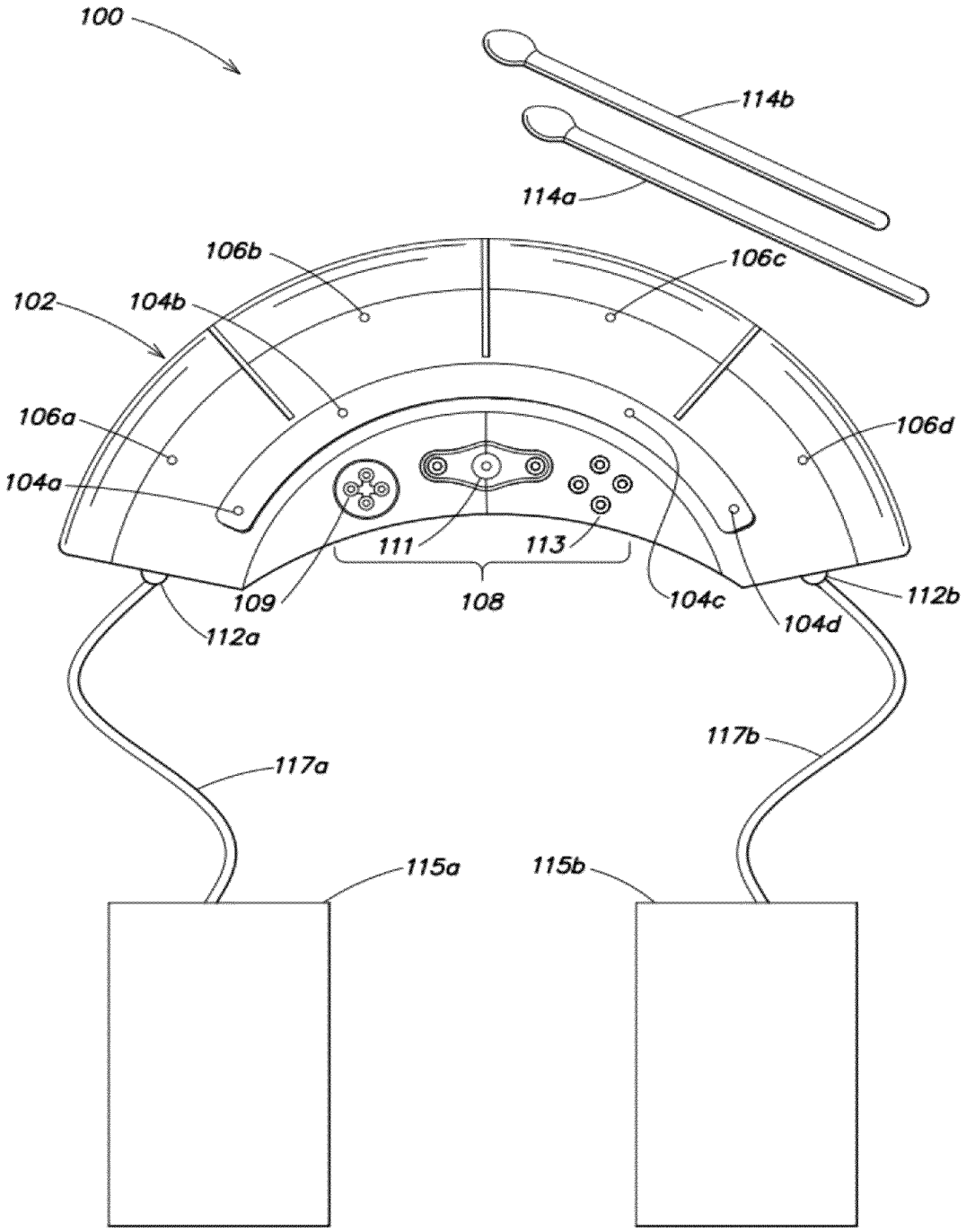
FIGS. 1A and 1B illustrate a top view and a perspective view, respectively, of an electronic game component having a plurality of receivers defining radiation striking zones, according to one non-limiting embodiment of the invention.

Some embodiments are directed to electronic game components which simulate a percussive instrument, such as a drum kit, a xylophone, marimba, etc. The electronic game components may be played similarly to the simulated percussive instrument, although without physical contact being made to an actual percussive component. Accordingly, some aspects of the present invention provide a virtual percussive instrument.

According to one aspect of the present invention, an electronic game component is provided that simulates a percussive instrument. The percussive instrument being simulated may be of the type including a single percussive component or a plurality of percussive components. For example, a drum kit having multiple drumheads may be simulated. The electronic game component may include a base module that defines a plurality of radiation striking zones, each corresponding to one of the percussive components of the simulated percussive instrument. According to one embodiment, the radiation striking zones are arranged and sized to simulate the percussive components of an actual instrument. The electronic game controller further includes (or is coupled to) processing circuitry that, in response to detecting a strike by a striker in any of the plurality of radiation striking zones, generates a signal indicating in which of the plurality of radiation striking zones the strike was detected. According to this aspect, a user may simulate playing the percussive instrument by suitably striking, e.g., with an appropriate striker, within the radiation striking zones defined by the electronic game component.

According to another aspect of the present invention, the electronic game component further includes at least one striker that includes a sensor that senses when the striker has been swung with a threshold value of a characteristic of motion of interest. As will be described further below, in one embodiment a suitable characteristic of motion is acceleration of the striker. According to this aspect, the electronic game component also includes at least one detector that detects a strike by the striker in any of the plurality of radiation striking zones. The strike may only be detected when the sensor of the striker senses that the striker has been swung with the threshold value of the characteristic of motion. The electronic game component according to this aspect of the present invention also includes processing circuitry that generates a control signal indicating in which of the radiation striking zones the strike was detected. The control signal may be used for a variety of purposes, including controlling generation of a sound and/or controlling some aspect of a video game, as will be described.

According to another aspect of the present invention, an electronic game system includes two or more strikers for striking the radiation striking zones, and processing circuitry that receives a detection signal indicating a strike by any of the strikers in any of the radiation striking zones. The processing circuitry may identify which of the strikers was used in striking the radiation striking zone, and generate a control signal in response to detecting the strike that indicates which of the strikers was used.

According to a further aspect of the present invention, an electronic device controller includes two or more sticks that each includes a motion sensor which senses the motion of the stick and a signal transmitter that transmits a signal identifying the stick. The signal identifying the stick may be transmitted in response to the motion sensor of the stick sensing that the motion (e.g., acceleration) of the stick satisfactorily compares to a threshold value.

According to a further aspect of the present invention, a drum kit console is provided that simulates a drum kit having a plurality of percussive components. The drum kit console includes two sticks, a base module defining a plurality of radiation striking zones that each corresponds to one of the percussive components of the simulated drum kit, and at least one detector that detects a strike by one of the two sticks in one of the radiation striking zones. In one embodiment, the radiation striking zones expand outwardly from the base module so that at some distance from the base module the radiation striking zones collectively define a surface area greater than the surface area of the base module.

According to one aspect of the present invention, the game components and systems described above, and below, may be used to play sounds, for example to simulate an instrument. They may also, or alternatively, be used to control a video game. Other uses are also possible, as the various aspects described herein are not limited to any particular use unless otherwise stated.

The aspects of the invention described above, as well as additional aspects, will now be described below in further detail. It should be appreciated that these aspects may be used alone, all together, or in any combination of two or more.

It will be appreciated from the following discussion that the phrases "game controller," "game component," and "game system" as used herein encompass items that may be used at least to control video and/or audio games, as well as items that may be used to simulate an instrument, such as a percussive instrument. Some embodiments may be implemented as stand-alone devices (e.g., with speakers and/or display screens) and others may interface with a game console (e.g., a game console that can be used to play a game on a television, computer or other device having a display screen and/or speakers).

Figure 1B:
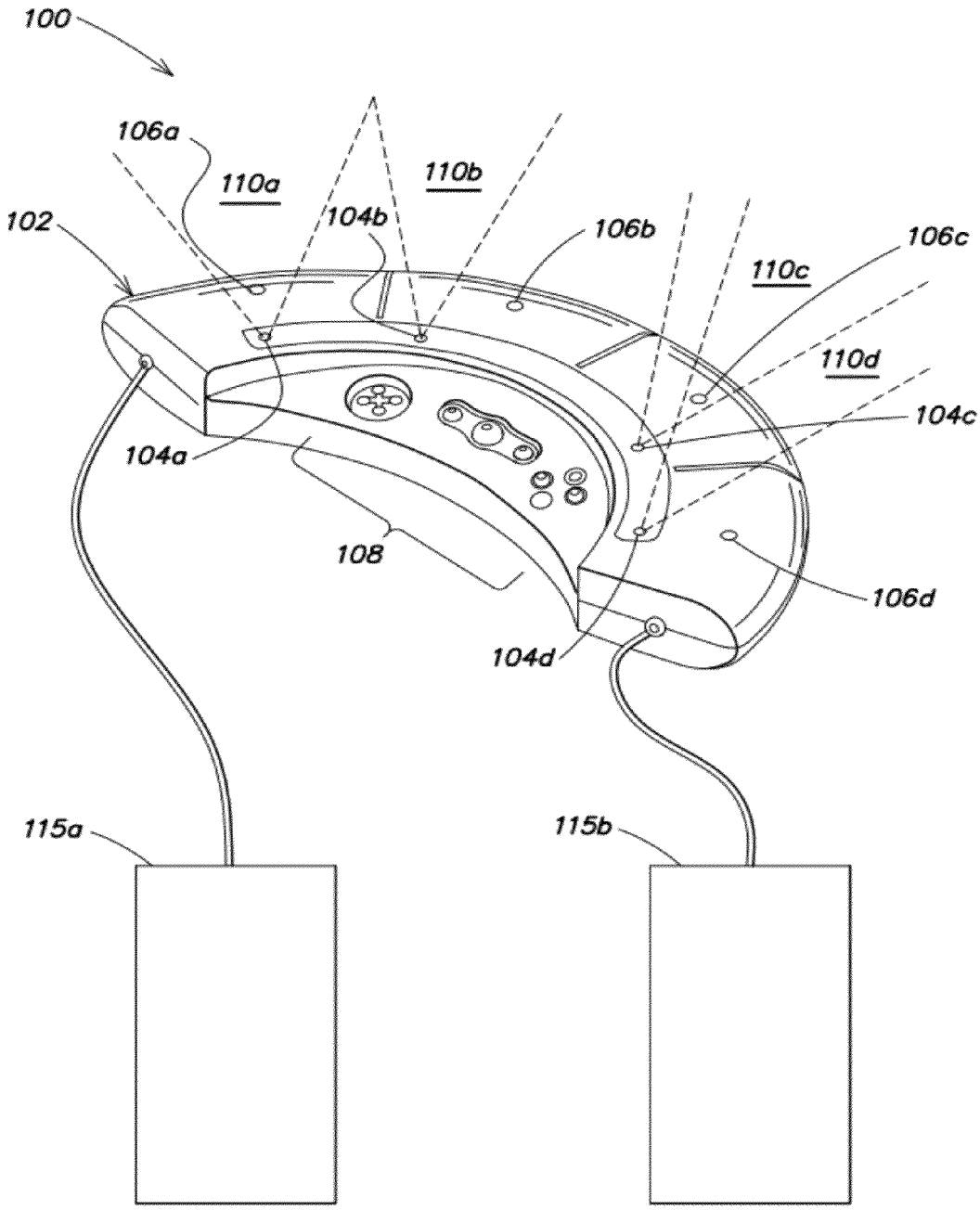

As mentioned, according to one aspect of the present invention, an electronic game component is provided which simulates a percussive instrument having a plurality of percussive components. FIGS. 1A and 1B illustrate a top view and a perspective view, respectively, of a non-limiting example of such an electronic game component, according to one embodiment. Referring to FIG. 1A, the electronic game component 100 includes a base module 102, in which are disposed a plurality of receivers 104*a*-104*d* and a plurality of indicators 106*a*-106*d*. Each of the indicators 106*a*-106*d* corresponds to one of the receivers 104*a*-104*d*. The base module 102 also includes control buttons 108. Additionally, the electronic game component includes foot pedals 115*a* and 115*b* coupled to input ports 112*a* and 112*b* of base module 102, respectively, via respective cables 117*a* and 117*b*. Exemplary functions for the indicators, foot pedals, and control buttons will be described below.

Referring to FIG. 1B, each of the receivers 104*a*-104*d* may be configured to define a corresponding radiation striking zone 110*a*-110*d*. Each of the radiation striking zones represents a zone within which suitably directed radiation (e.g., electromagnetic radiation) may be received by the corresponding receiver, and therefore corresponds to the field of view of the receiver in this non-limiting embodiment. Thus, as will be described further below, a strike by a suitable striker within a radiation striking zone may be detected by the corresponding receiver.

Figure 1C:
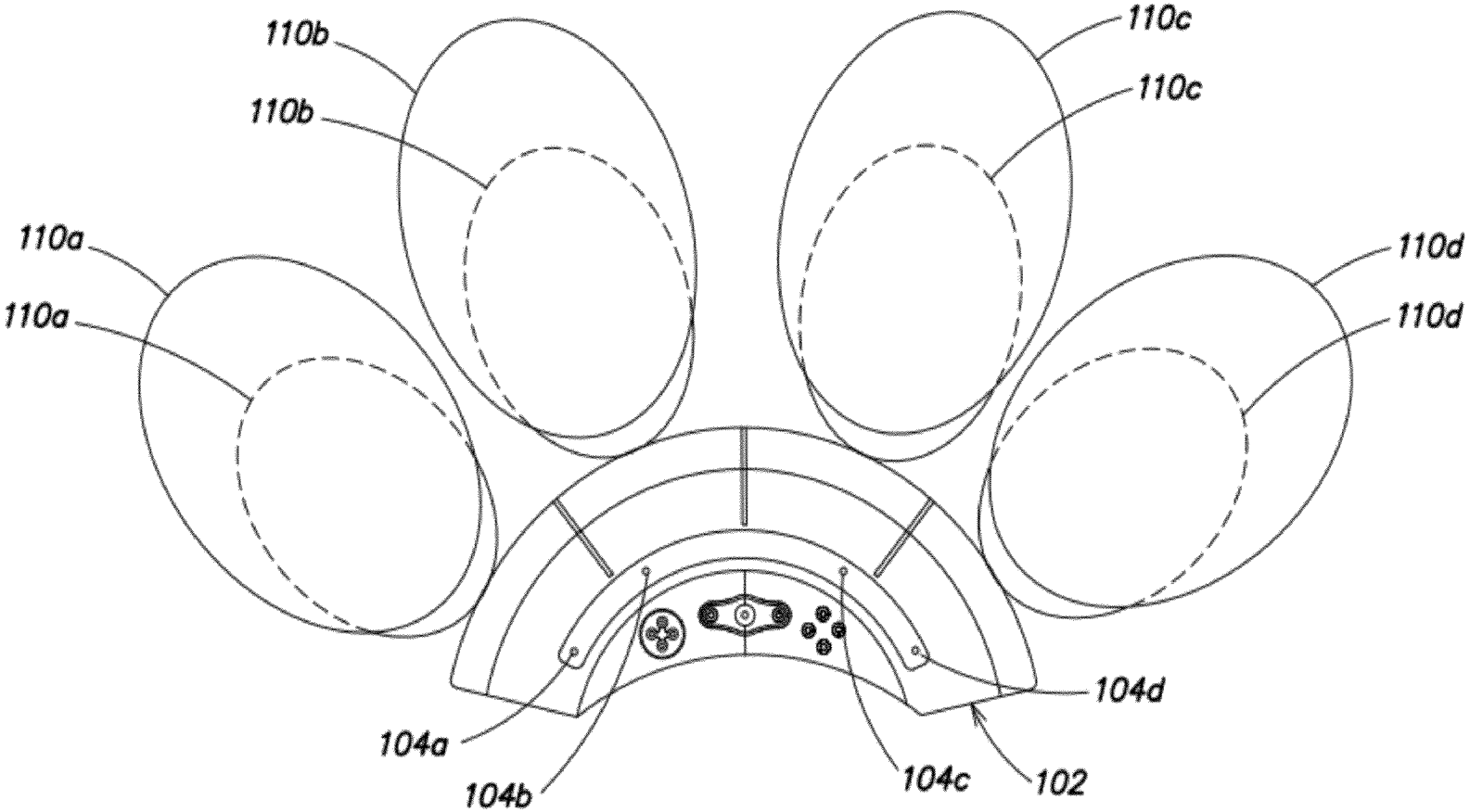
FIG. 1C illustrates a top view of the radiation striking zones of FIG. 1B at two different distances from the base module 102, according to one non-limiting embodiment of the invention.
Figure 1D:
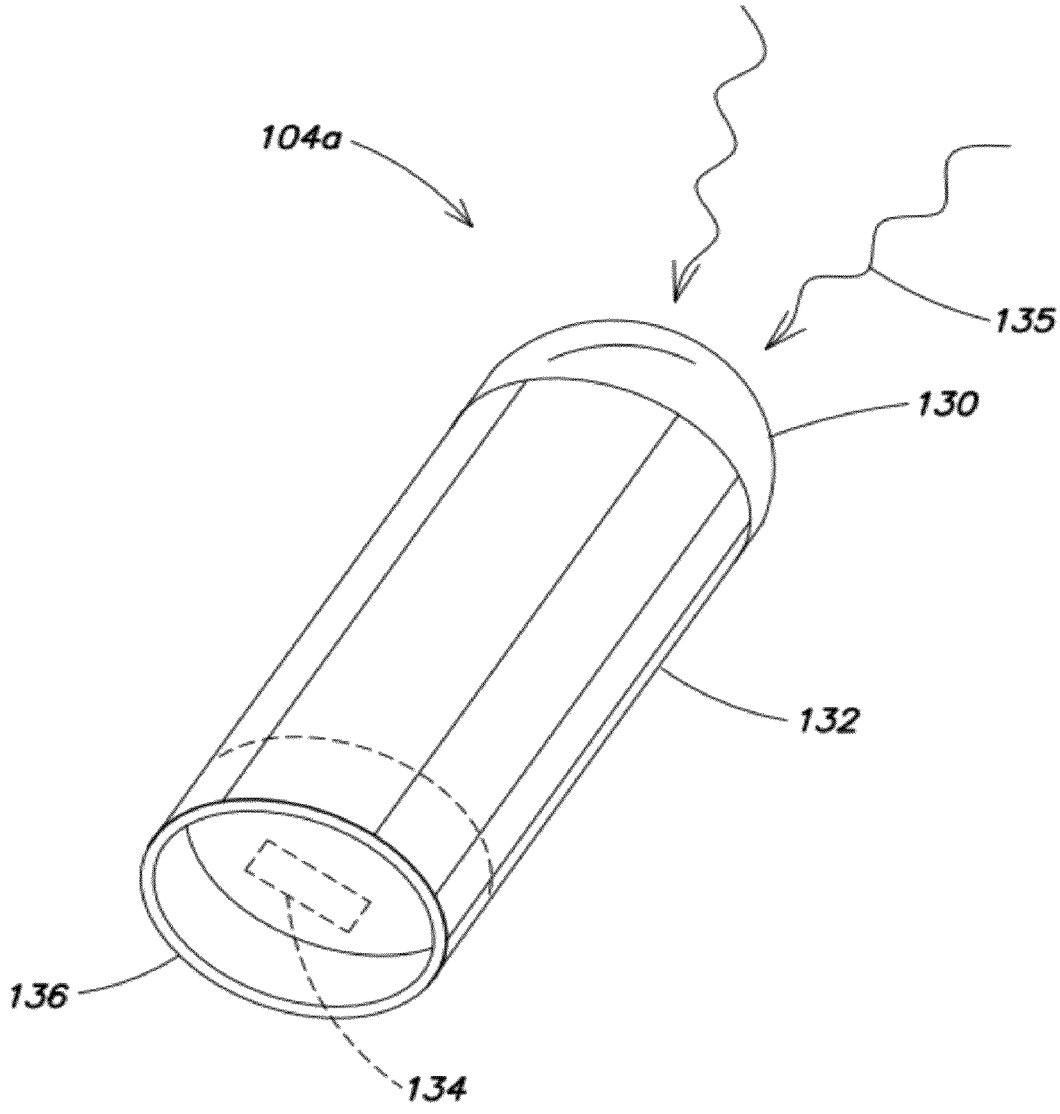
FIG. 1D illustrates a non-limiting example of a receiver of the electronic game component of FIGS. 1A and 1B.

Each of the receivers 104*a*-104*d* may include a detector and optics (e.g., lenses, filters, collimators, reflectors, etc.) which define the radiation striking zone for that receiver. FIG. 1D provides a non-limiting example, illustrating a perspective view of receiver 104*a*. As shown, the receiver 104*a* may include a lens 130, a collimator tube 132, and a detector 134. The lens 130 and collimator tube 132 may be of any suitable types for defining a desired radiation striking zone, and may have any suitable sizes, shapes, and positions. According to one embodiment, the collimator tube 132 may be adjustable, for example in terms of its positioning relative to detector 134, which may allow for adjusting the corresponding radiation striking zone. Incident radiation 135 may be directed by the lens 130 and collimator tube 132 to the detector 134, which may be mounted on a base 136. The detector may be a photodiode, phototransistor, or any other type of detector suitable for detecting a type of radiation of interest (e.g., infrared radiation), as will be described further below in connection with the strikers 114*a* and 114*b*.

It should be appreciated that the configuration of receiver 104*a* illustrated in FIG. 1D is merely one non-limiting example, and that the receivers described herein may have any suitable components and configuration for defining a desired radiation striking zone. For example, according to one embodiment one or more of the receivers 104*a*-104*d* may include a detector and a collimator tube, but no lens. Other configurations are also possible.

The size and shape of each of the radiation striking zones 110*a*-110*d* may be designed, for example, to simulate percussive components of a percussive instrument. For example, according to one embodiment the electronic game component 100 may be used to simulate a drum kit, which is one non-limiting example of a percussive instrument that may be simulated. The radiation striking zones 110*a*-110*d* may be shaped, positioned, and/or sized to simulate conventional shapes, positions, and sizes of a snare drum, one or more toms, a cymbal, or any other components of the simulated drum kit. Percussive instruments other than drum kits may also be simulated, for which the radiations striking zones may be shaped, positioned, and/or sized to simulate the components of those percussive instruments.

However, not all embodiments of an electronic game controller defining a plurality of radiation striking zones are limited to the radiation striking zones being defined according to conventional shapes, positions, and sizes of the simulated percussive components, as any desired shape, position, and size is possible. For example, according to an alternative embodiment, one or more of the radiation striking zones may be defined, for example, to facilitate design of the components used to define the radiation striking zones, or to facilitate operation of the electronic game component, for example with respect to the ability of the game component to distinguish between strikes in different ones of the radiation striking zones.

According to one embodiment, two or more of the radiation striking zones 110*a*-110*d* are substantially the same as each other in size and shape. Such a design may simplify the construction of the base module, may facilitate the ability of the game component to detect strikes in different radiation striking zones, and/or may facilitate playing by a user (e.g., users having little experience with the type of percussive instrument being simulated). Suitable shapes for the radiation striking zones may include elliptical and circular cross-sections, but others are possible. Suitable sizes may be those that approximate the sizes of drumheads (or the components of other percussive instruments), sizes that are large enough to provide a user some margin of error when attempting to strike within a particular radiation striking zone, or any other suitable sizes. As a non-limiting example, a radiation striking zone may have a circular cross-section having a diameter of between approximately 3 inches to 24 inches, among others. FIG. 1C illustrates a non-limiting example.

FIG. 1C is a top view (i.e., looking down toward the base module 102) of a non-limiting example of the sizes and shapes of radiation striking zones 110*a*-110*d* at two different distances from the base module 102. The cross-section of each radiation striking zone at the first distance is represented by a partially solid and partially dashed outline, whereas the cross-section of each radiation striking zone at the second distance is represented by a fully solid outline. This is because, in this non-limiting example, the first distance is less than the second distance (i.e., the first distance is closer to the base module 102), such that in the top-down view of FIG. 1C the cross-sections at the first distance would be below the cross-sections at the second distance.

As shown, at a first distance from the base module 102 each of the radiation striking zones 110*a*-110*d* may have an approximately elliptical cross section with a major radius of between approximately 1 and 4 inches, or any other suitable dimension. At a second distance from the base module 102, greater than the first distance, each of the radiation striking zones 110*a*-110*d* may again have an approximately elliptical cross section, this time having a major radius greater than that of the corresponding radiation striking zone at the first distance. For example, according to one non-limiting embodiment each of the radiation striking zones 110*a*-110*d* may have a major radius of between approximately 2 to 12 inches at the second distance, or any other suitable dimension. According to an alternative embodiment, each of the radiation striking zones may have a nearly circular cross-section of approximately 5 inches in diameter at the first height and approximately 8 inches in diameter at the second height. According to either of the previous two embodiments, the first distance may be approximately 24 inches from the base module and the second distance may be approximately 36 inches, although it should be appreciated that the radiation striking zones may be designed to have any desired cross-sectional areas at a desired distance from the base module. By reference to FIG. 1C it should be appreciated that, according to one embodiment, a combined surface area of the radiation striking zones at a particular distance from the base module may be greater than the surface area of the base module itself. Also, it should be appreciated that, according to some embodiments of the present invention, the radiation striking zones expand as the distance from the base module increases. Not all embodiments are limited in this manner, as will be described below.

One manner in which the illustrated cross sections of the radiation striking zones 110*a*-110*d* may be created is by defining the radiation striking zones to be approximately conical (e.g., having a half angle of between 5 and 15 degrees, between 10 and 20 degrees, of approximately 10 degrees, or any other suitable half angle). This may be achieved by using, for example, a suitable lens and collimator configuration for the corresponding receiver. As FIG. 1C illustrates a top view of the radiation striking zones, the elliptical cross sections may be achieved by tilting the receivers with respect to the vertical axis, which also accounts for the radiation striking zones appearing offset from the corresponding receivers in FIG. 1C. The receivers may be tilted at any suitable angle with respect to the vertical axis of the base module 102. Non-limiting examples of suitable degrees of tilt are between 5 and 15 degrees, 15 and 25 degrees, 25 and 40 degrees, or any other suitable angle. In those embodiments in which the plurality of radiation striking zones are defined at an angle with respect to the vertical axis of the base module, the angle may be chosen to facilitate playing of the electronic component by a user. For example, the receivers may be tilted toward a location at which a user may be sitting when using the electronic game component, so that the plurality of radiation striking zones are projected toward the user, as will be further described below with respect to FIG. 7A.

As also illustrated in FIG. 1C, the receivers, and therefore the plurality of radiation striking zones, may be positioned in any suitable manner. In the non-limiting example of FIG. 1C, the receiver 104*a* may be spaced from the receiver 104*b* by between approximately 1 and 4 inches. Similarly, the receivers 104*c* and 104*d* may be spaced from each other by approximately the same distance. The receivers 104*b* and 104*c* may be spaced from each other by a larger distance, for example, by between approximately 3 and 5 inches. However, the spacing of the receivers is not limiting and may be chosen to achieve a desired positioning of the radiation striking zones at a distance of interest from the base module 102.

According to one aspect of the present invention, the radiation striking zones may be defined such that they do not overlap each other within a certain target distance of the base module, for example at a distance from the base module at which it is anticipated strikes will be made by a user. According to one embodiment, the radiation striking zones may be defined to not overlap or intersect each other within approximately 24 inches of the base module, within approximately 36 inches of the base module, within approximately 40 inches of the base module, within approximately 48 inches of the base module, or any other suitable distance. For example, referring again to FIG. 1C, it is seen that the radiation striking zones do not overlap each other at either of the first distance or the second distance. As a result, it may be simpler for the user to accurately determine which zone is being struck and for the system to determine in which of the radiation striking zones a strike is detected since, for example, in some embodiments only one of the receivers 104*a*-104*d* may detect a strike from a particular striker at any given time. However, according to some embodiments, it may be desirable for the spacing between the radiation striking zones to be small or non-existent, for example to minimize the occurrence of a user unintentionally striking between the radiation striking zones when the user had intended to strike one of the radiation striking zones. Accordingly, in one embodiment the radiation striking zones may be defined such that the boundaries of the radiation striking zones contact each other, or even overlap, within a plane in which it is expected strikes may be made by user. Thus, the various aspects described herein are not limited to the radiation striking zones either overlapping each other or not overlapping each other, unless otherwise stated.

In those embodiments in which two or more of the radiation striking zones are designed to overlap each other at a distance from the base module at which strikes may be made by a user using a suitable striker, the receivers corresponding to the overlapping radiation striking zones may both detect the same strike by the user. In such situations, any suitable scheme may be used for attributing the strike to one of the radiation striking zones, or the strike may be attributed to multiple zones. For example, according to one embodiment, the strike may be attributed to the leftmost (from the point of view of a user) radiation striking zone of those radiation striking zones detecting the same strike. According to another embodiment, when multiple receivers detect the same strike, the strike may be ignored (i.e., not attributed to any of the radiation striking zones). Other schemes are also possible.

According to one embodiment, rather than defining the radiation striking zones to expand as the distance from the base module increases, as shown in FIG. 1C, the radiation striking zones may be defined to have an approximately constant cross section as the distance from the base module increases. For example, according to one embodiment, one or more of the radiation striking zones may have an approximately cylindrical shape having an approximately constant cross section as the distance from the base module increases. Such a result may be achieved, for example, by using a parabolic reflector in the corresponding receiver, suitably positioned with respect to the detector of the receiver. The parabolic reflector may have a diameter approximately matching that of the desired cross section of the resulting radiation striking zone. Another manner in which a radiation striking zone having an approximately constant cross section may be achieved is using a parallel hole collimator. Alternatives are also possible.

According to one embodiment, the positions of the receivers within the base module 102 may be adjusted. As a result, the positions of the corresponding radiation striking zones may be adjusted, which may allow a user to position the radiation striking zones in a manner that, for example, facilitates striking within the radiation striking zones or that simply complies with user preferences. For example, according to one embodiment, the angle of a receiver within the base module may be adjusted, for example by pivoting the receiver within the base module. Such functionality may be provided in any suitable manner. According to one embodiment, a receiver may be mounted on a pivoting ball disposed on or at least partially within the base module, such that a user may adjust the angle of the receiver with respect to the base module by rotating the ball (e.g., by +/−90 degrees, or any other suitable amount), for example to angle the corresponding radiation striking zone in a desired direction. Other manners for allowing the adjustment of the angle of the receivers are also possible, and the various embodiments described herein relating to adjustable receivers are not limited in the manner in which such adjustability is provided. Furthermore, as the base module need not be fixed (e.g., to the floor) in all embodiments, moving the base module itself may allow for positioning the receivers and therefore the radiation striking zones at desired locations.

It should be appreciated that the radiation striking zones 110*a*-110*d* may not be visible to a user. For instance, as previously mentioned, the radiation striking zones may correspond to a field of view of the corresponding receiver, such that there is no physical indication of the radiation striking zone which a user may see. Alternatively, according to one embodiment, one or more light sources may be arranged to illuminate the boundaries of the radiation striking zone, which may be done to facilitate user interaction with the electronic game component. Other manners of making the radiation striking zones visible to a user may also be used.

FIG. 1A also illustrates strikers 114*a* and 114*b* which may be used to strike within the radiation striking zones 110*a*-110*d*. According to one embodiment, the strikers 114*a* and 114*b* may be part of the electronic game component 100, although in other embodiments the strikers 114*a* and 114*b* may be separate from the electronic game component 100. As will be described further below, according to one embodiment the strikers 114*a* and 114*b* may be designed to simulate a component that would typically be used with the percussive instrument being simulated by the electronic game component. For example, if the electronic game component is being used to simulate a drum kit, one or both of the strikers 114*a* and 114*b* may be designed to simulate a drumstick. In this manner, a user may realistically simulate playing the drums by using the electronic game component 100, and in this sense the electronic game component may act as a virtual drum kit. However, drumsticks are merely one non-limiting example of a striker which may be used in connection with a percussive instrument, and the various embodiments described herein are not limited to strikers designed to simulate drumsticks, as the strikers can simulate strikers used with other percussive instruments or take any other desired form.

Figure 2:
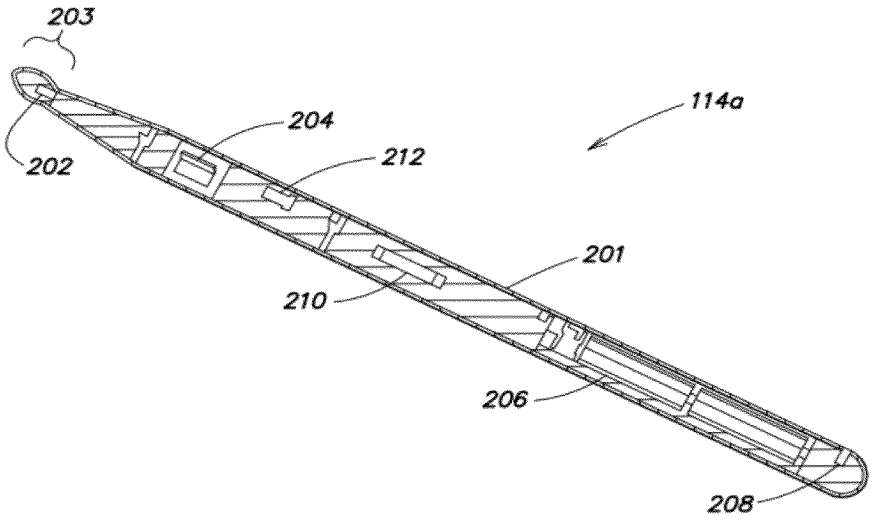
FIG. 2 illustrates a cross-section of a striker which may be used in connection with the electronic game component of FIGS. 1A and 1B, according to one non-limiting embodiment of the present invention.

The strikers 114*a* and 114*b* may be configured to interact with the base module 102 by transmitting signals that may be received by the receivers 104*a*-104*d*. A particular one of the receivers 104*a*-104*d* may receive a signal transmitted by one of the strikers 114*a* and 114*b* if the striker is located within the corresponding radiation striking zone and the signal transmitted by the striker is suitably directed toward the receiver. FIG. 2 illustrates an example of a striker 114*a* according to one non-limiting embodiment.

As shown, the striker 114*a* has a housing 201 which may be shaped to simulate a striker that would be used in connection with a percussive instrument being simulated by the electronic game component. In the non-limiting example of FIG. 2, the striker 114*a* is formed substantially like a drumstick. According to one embodiment, the striker 114*a* may be designed, in terms of shape, size (e.g., length, diameter, etc.), weight, and/or feel to simulate any standard drumstick size (e.g., a 5B drumstick, among others).

As mentioned, according to one aspect of the present invention, a striker may communicate with a base module of an electronic game component, such as base module 102, by transmitting signals which may be detected by one or more receivers of the base module. Accordingly, as shown in FIG. 2, the striker 114*a* may include a transmitter 202 for transmitting signals which may be detected by the receivers of a base module. The transmitter may be positioned at any suitable point of the striker 114*a*, such as near or in the tip 203 of the drumstick. Other positions are also possible. Also, the transmitter and/or housing 201 of the striker may be configured such that emission from the transmitter is directional, i.e., directed in a particular direction. For example, the transmitter may have a transmission angle of approximately 120 degrees (i.e., +/−60 degrees) in some embodiments, or any other suitable transmission angle. According to one embodiment, at least a portion of the housing 201 is made of a material transparent to the type of radiation emitted by transmitter 202, which portion may be configured to allow emission of the transmitter signal from the striker 114*a*. Alternatively, the housing 201 may include a hole or opening configured to allow emission of the transmitter signal. Other configurations for the striker 114*a* to allow for emission of the transmitter signal are also possible.

The transmitter 202 may be any suitable type of transmitter for communicating with the receivers of a base module. For example, according to one embodiment the transmitter may transmit electromagnetic signals in a wavelength detectable by the detectors of the receivers 104*a*-104*d*. According to one embodiment, the transmitter 202 may be an infrared (IR) transmitter, transmitting signals at infrared wavelengths. In such an embodiment, the receivers 104*a*-104*d* may include detectors which detect in the wavelengths transmitted by the transmitter 202. As a non-limiting example, the transmitter 202 may transmit at approximately 950 nanometers (nm), in the IR band. Use of such a wavelength may reduce interference with other devices with which the electronic game component may interact, such as a video game console, as will be described further below.

However, it should appreciated that the various aspects of the invention described herein are not limited to utilizing any particular wavelength of transmission of the strikers. For example, according to another embodiment, the transmitter 202 may transmit at one or more wavelengths between approximately 830 nm and 1000 nm. According to another embodiment, the transmitter 202 may transmit at one or more wavelengths between approximately 650 nm and 1000 nm. Other wavelength ranges, including those in the visible spectrum, may also be used in some embodiments. According to another embodiment, radio frequency emission is used, and according to another still Bluetooth® is used. Also, the various communications links within electronic game component need not all use the same type of emission. For example, receiver 104*a* may receive a first wavelength of emission and receiver 104*b* may receive a different wavelength.

According to one embodiment of the present invention, the transmitter 202 may transmit a signal (e.g., continuously or substantially continuously), which may be received by any one or more of the receivers 104*a*-104*d* when the striker is located within the corresponding radiation striking zone and suitably directed toward the receiver. In such a scenario a user may be able to trigger a response by the base module 102 without the need to manipulate the striker in a manner corresponding to the manner in which the striker of the simulated percussive instrument would be used.

According to another aspect of the present invention, the operation of the striker 114*a* may be designed to enhance the realism for the user of playing the simulated percussive instrument. Thus, according to one embodiment, the transmitter 202 may be configured to transmit a signal when the striker 114*a* is manipulated by a user in a manner substantially corresponding to that in which a striker of the simulated percussive instrument would be manipulated. For example, the transmitter 202 may be configured to transmit a signal when the striker 114*a* is manipulated in a manner resembling a striking motion that would be used to play the simulated percussive instrument. In this way, simulation of the percussive instrument may be more realistic than in the previously described embodiment. Such realism may, for example, enhance the user's enjoyment as well as the educational or training functionality of the electronic game component.

In those embodiments in which the striker 114*a* is configured to only transmit a signal when manipulated in a manner similar to that in which a striker of the simulated percussive instrument would be manipulated, the determination of whether the striker 114*a* has been properly manipulated may be based on a characteristic of motion of the striker. For example, a user playing the percussive instrument being simulated by the electronic game component 100 may swing a striker with a characteristic force, acceleration, velocity, or direction. Thus, characteristics of motion of the striker 114*a* such as the force used in swinging the striker, the striker's acceleration (which, in this application, encompasses "deceleration," i.e., positive or negative acceleration, unless the context indicates otherwise), velocity, and/or direction may be used to assess whether the striker has been suitably manipulated to generate a transmitter signal from the transmitter 202. Detection of such characteristics of motion may be performed in any suitable manner (e.g., using a suitable motion sensor in or on the striker), as various aspects described herein are not limited to detecting the motion of the striker 114*a* in any particular manner. It should be appreciated that, as used herein, "detecting" or "determining" a particular characteristic of motion (e.g., detecting the acceleration of a striker) does not necessarily require quantifying the characteristic of motion. For example, detecting or determining an acceleration of the striker does not necessarily require determining an actual acceleration value of the striker.

According to one embodiment of the present invention, the striker 114*a* may be configured to transmit a signal only when the striker is accelerated/decelerated sufficiently, since, for example, the acceleration/deceleration may indicate whether the striker has been manipulated in a manner that would simulate striking a drumhead or other percussive component of a percussive instrument (e.g., a drumstick typically decelerates when making contact with a drumhead). Accordingly, the striker 114*a* may include a sensor or other device configured to detect the acceleration (or other characteristic of motion of interest) of the striker 114*a* and enable transmission of a signal from the striker (e.g., by enabling the transmitter 202) only when the detected acceleration (which, as discussed above can include deceleration) satisfies a predetermined condition, for example, meeting a threshold acceleration/deceleration value. Considering the non-limiting example of striker 114*a*, the striker includes a motion switch 204 to detect the acceleration of the striker. The motion switch 204 may be an inertia switch or any other suitable type of motion switch for detecting the acceleration/deceleration of the striker 114*a*. The motion switch may be configured to enable the transmitter 202 to transmit an output signal when the detected acceleration/deceleration is sufficient, an example of which operation is described below in connection with FIG. 3B. According to one embodiment, the striker may additionally comprise a processor 212, such as a PIC processor, which may be coupled to the motion switch and configured to process signals provided by the motion switch to determine the acceleration/deceleration of the striker and/or compare a detected acceleration/deceleration to a threshold.

Figure 3A:
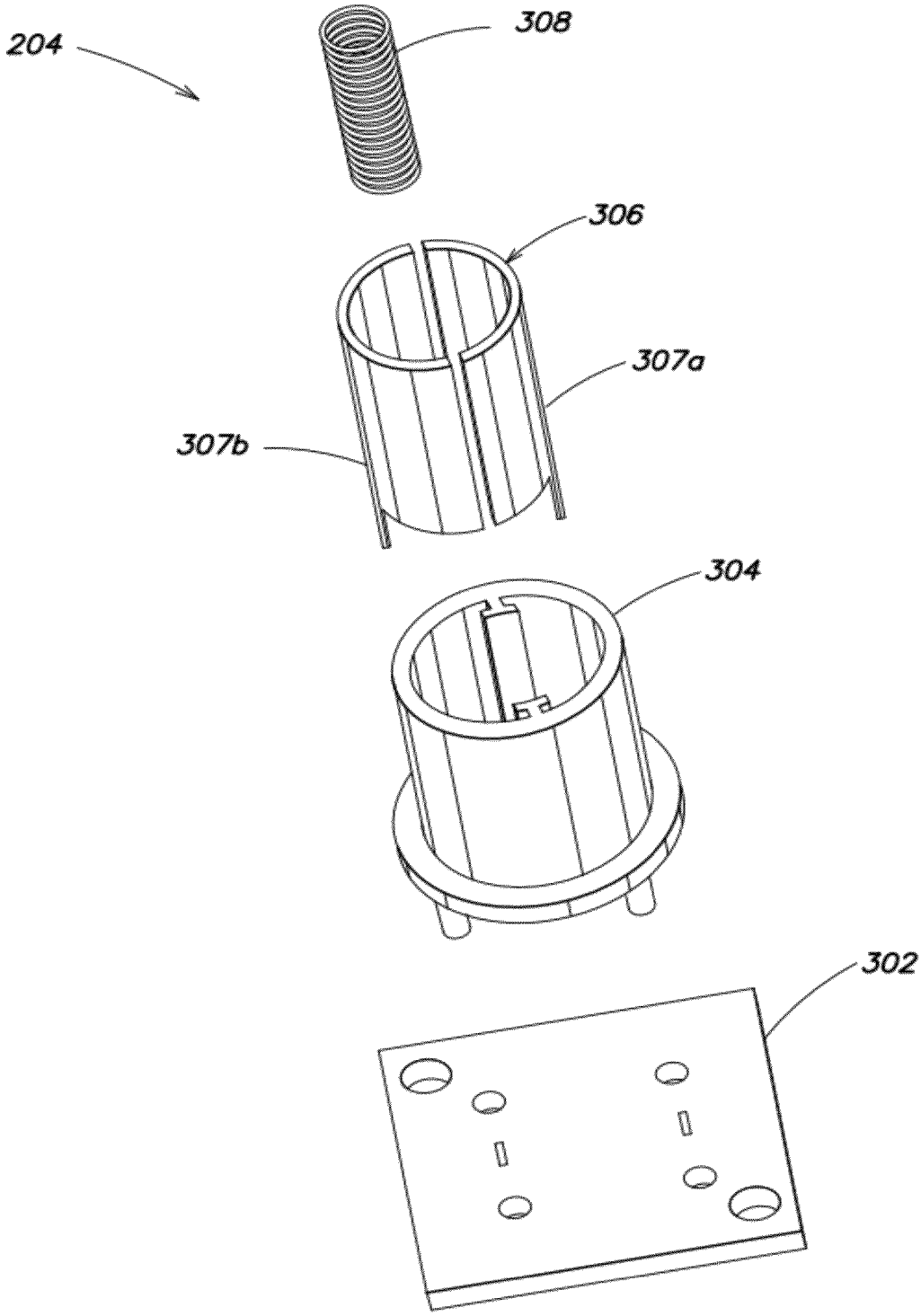
FIG. 3A illustrates a non-limiting example of the motion switch of the striker of FIG. 2, according to one non-limiting embodiment of the present invention.

The motion switch 204 may take any suitable design, one non-limiting example of which is illustrated in exploded view in FIG. 3A. In this example, the motion switch 204 is a single-pole double-throw (SPDT) switch including a base 302, an insulating shell 304 in which is disposed a contact 306 (including a first contact portion 307*a* and a second contact portion 307*b* electrically isolated from each other), and a spring 308. The spring may have one fixed end (e.g., fixed to the base 302) and one free end (i.e., free to deflect), and may be disposed coaxially within the contact 306. The motion switch 204 may be aligned within the striker 114*a* such that the spring 308 has a central axis aligned with a central axis of the striker (e.g., the spring may be disposed coaxially within the striker 114*a*), although any suitable configuration may be used.

In operation, the positioning of the free end of the spring depends on the acceleration/deceleration of the striker. In the absence of an acceleration/deceleration (e.g., when the striker is at rest), the free end of the spring may remain substantially centered within the contact 306, not contacting either of the contact portions 307*a* or 307*b*. However, in response to an acceleration/deceleration of the striker 114*a*, the free end of the spring may deflect toward one of the contact portions 307*a* and 307*b*. If the acceleration/deceleration is sufficient, the free end of the spring may come into contact with one of the contact portions, which may close an electric circuit and generate a signal indicating that the spring has contacted the contact portion. In this manner, the motion switch may operate as a switch that is closed when the striker is sufficiently accelerated/decelerated and that is open in the absence of sufficient acceleration/deceleration.

The split contact design (i.e., the electrical separation of contact portions 307*a* and 307*b*) of the contact 306 may facilitate detection of the level of acceleration/deceleration of the striker. For example, when a striking (or swinging) motion is initially begun by a user holding the striker 114*a*, the motion switch may undergo an acceleration which may displace the spring 308 (e.g., the free end of the spring) such that it contacts one of contacts 307*a* and 307*b*. The spring may remain in contact with contact portion 307*a* or 307*b* as long as the striker continues its acceleration. Toward the end of the striking (or swinging) motion, the user may decelerate the striker 114*a* (e.g., to simulate striking a percussive component), such that the spring 308 breaks contact with the originally contacted contact portion 307*a* or 307*b* and, presuming the deceleration is sufficient, comes into contact with the other of 307*a* and 307*b*. The time duration between when the spring 308 breaks contact with the first of the contact portions 307*a* or 307*b* and the time at which it subsequently contacts the other of the contact portions may provide an indication of the velocity of the striker at the time when it was initially decelerated (i.e., the time at which the spring 308 broke contact with the first of the contact portions 307*a* and 307*b*), and may also be indicative of the acceleration (or deceleration) of the striker 114*a*. The time duration may be compared to a threshold value, and the transmitter 202 may only be enabled if the threshold value is greater than or equal to the time duration between contacts, which may indicate the acceleration/deceleration of the striker satisfactorily compares to a target acceleration/deceleration value, examples of which are discussed below.

The time duration associated with the above-described operation may take any suitable value(s), and may depend, for example, on the design of the motion switch 204. For example, the time between when the spring contacts a first one of the contact portions 307*a* or 307*b* and when the spring contacts the other of the contact portions may depend on the velocity of the striker and distance between the contact portions. Suitable distances between the contact portions may be between two and four millimeters (e.g., approximately 3 mm), or any other suitable value. For typical swings of the striker (e.g., having typical velocities as might be expected for use a percussive instrument), the time duration may therefore range between 50 microseconds and 2.5 milliseconds, as non-limiting examples. Accordingly, the threshold duration discussed above, to which a measured time duration may be compared, may be set at any suitable value (e.g., between approximately 75 microseconds and 2.5 milliseconds, or any other suitable value) for determining whether a striker has been appropriately swung.

Figure 3B:
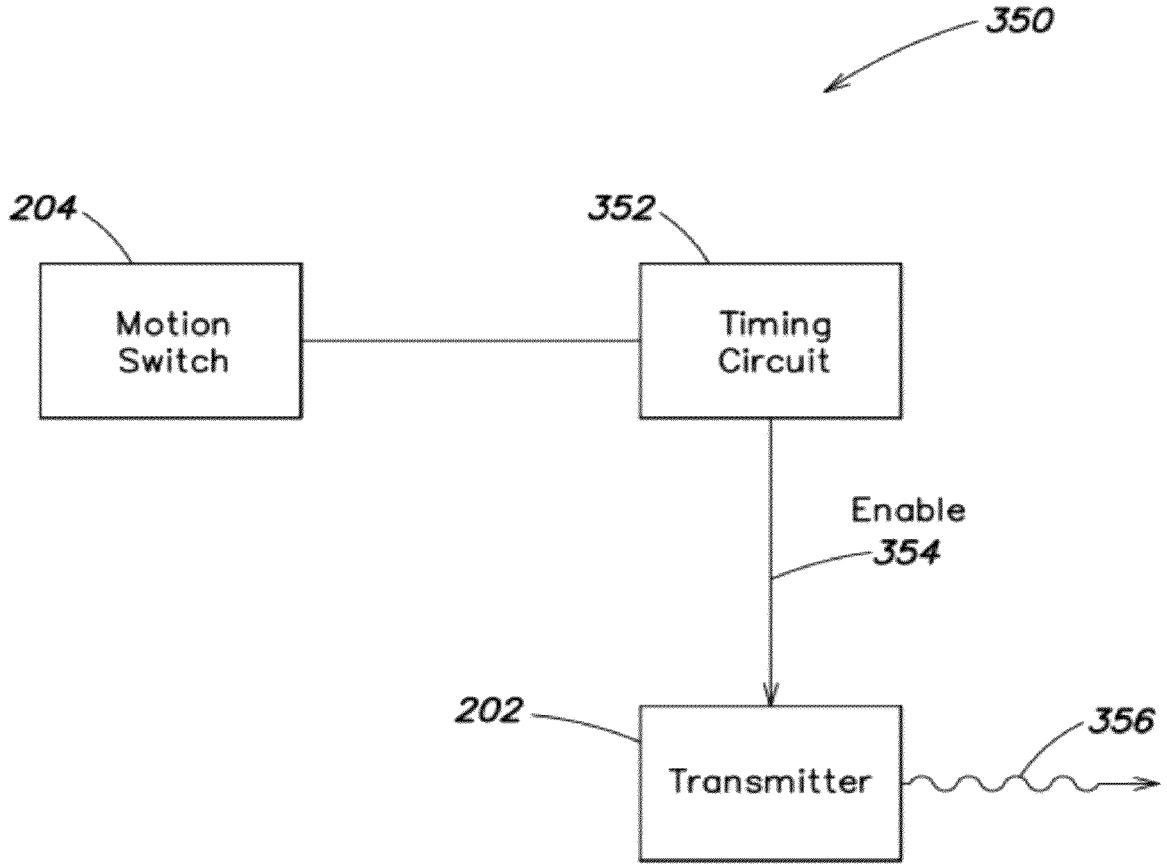
FIG. 3B illustrates a circuit configuration which may be used with the striker of FIG. 2, according to one non-limiting embodiment of the present invention.

An example of a circuit configuration which may be used in connection with the motion switch 204 of the type illustrated in FIG. 3A is illustrated in FIG. 3B. As shown, the circuit 350 includes the motion switch 204, a timing circuit 352, and the transmitter 202. The timing circuit may be coupled to the motion switch 204 to determine a time duration between when a first of the contact portions 307*a* and 307*b* is contacted by the spring 308 and when the other of the contact portions is contacted, during a striking motion of the striker 114*a*. For example, the timing circuit may include a timer that is triggered by contact of the spring 308 to one of the contact portions 307*a* or 307*b* and then is stopped when the spring 308 contacts the other of the contact portions. The elapsed time may then be compared to a threshold time (e.g., between approximately 75 microseconds and 2.5 milliseconds, or any other suitable value), as explained above, which may provide an indication of the acceleration of the striker 114*a*. If the elapsed time is sufficiently short, an enable signal 354 may be provided to the transmitter 202, thus resulting in generation of a transmitted output signal 356. According to one embodiment, the functionality of timing circuit 352 may be performed by a PIC processor in the striker (e.g., processor 212), although other suitable processing circuitry may alternatively be used.

It should be appreciated that the circuit 350 is one non-limiting example of a circuit that may be used in connection with a motion switch of a striker according to an embodiment of the present invention. In addition, the type of motion switch illustrated in FIG. 3A is itself a non-limiting example of a suitable motion switch for use in a striker of the type illustrated in FIG. 2. Other types of motion switches may alternatively be used. In addition, other types of acceleration detectors may be used for detecting the acceleration of the striker 114*a*. For example, the striker 114*a* may include an accelerometer configured to measure the acceleration of the striker along one or more axes. In such an embodiment, the acceleration output along an axis of interest may be compared to a threshold value, and the transmitter 202 may be enabled if the detected acceleration value surpasses a predetermined threshold. Thus, it should also be appreciated that the timing processing described above with respect to the timing between when spring 308 contacts contact portions 307*a* and 307*b* is not limiting, and that any suitable type of processing may be performed to determine the characteristic of motion of interest of the striker, depending on the characteristic and the type of sensor used to detect the characteristic.

According to one embodiment, the motion switch 204, or other detector of the striker 114*a* in those embodiments in which an alternative type of detector is used, may allow determination of various degrees of acceleration/deceleration. For example, the circuit illustrated in FIG. 3B may be used to determine different degrees of acceleration based on the time duration detected by timing circuit 352. The different degrees of acceleration/deceleration may be used to control a response generated by the base module 102. For example, in some embodiments, the degree of acceleration/deceleration may be used to control the volume of a sound generated by base module 102 or by a component connected to base module 102, as will be described further below. For example, a first degree of acceleration may generate a first volume while a second, higher degree of acceleration may generate a second, louder volume. The degrees of acceleration/deceleration which may be detected may depend on the type of motion switch or other detector used in the striker 114*a*. According to one embodiment, between 2-8 degrees of acceleration may be detected. For example, considering the above-described motion switch of FIG. 3A, up to eight degrees of acceleration may be detected in one embodiment by comparing the time duration between when the spring contacts contact portions 307*a* and 307*b* to as many as seven threshold values (e.g., to as many as seven different values between 75 microseconds and 2.5 milliseconds, or any other suitable values). As will be described further below, the output signal 356 of the transmitter 202 may, in some embodiments, include an indication of the detected degree of acceleration.

Furthermore, use of a motion switch of the type illustrated in FIG. 3A may allow determination of the direction of motion of the striker 114*a*. For example, the direction of motion may be determined by determining the order in which contact portions 307*a* and 307*b* are contacted by the spring 308. Thus, according to one embodiment, generation of a transmitter signal by transmitter 202 may depend both on whether a sufficient acceleration/deceleration is detected as well as the direction of motion. For example, in one embodiment, the output signal 356 may only be generated when the striker 114*a* is swung downward, rather than upward. However, not all embodiments are limited in this respect.

According to one embodiment, the striker 114*a* may be further configured to provide force feedback to the user when the striker is manipulated in the desired manner, e.g., when it is swung with sufficient force. Such feedback may be provided in various suitable manners. According to one embodiment, a feedback mechanism 210 may be provided in the striker to provide the force feedback when the striker is appropriately manipulated. As a non-limiting example, the feedback mechanism 210 may be a passive moving weight which moves when the striker is swung. The movement of the weight may generate a tactile sensation the user can feel when the striker is suitably swung. Alternatively, the feedback mechanism may be a type of vibratory indicator that is triggered by the motion switch 204 in the same manner that the transmitter may be triggered, as described above. Thus, for example, when the striker 114*a* is suitably swung the motion switch 204 may close, triggering vibration of the feedback mechanism 210. The feedback mechanism may be of the type used in cellular telephones and pagers to provide the "vibrate" functionality (e.g., a motor unbalanced by an offset mass), or any other suitable type. Alternatively, in those embodiments in which the feedback mechanism vibrates, the vibration may be triggered only when the user suitably strikes with the striker 114*a* in an appropriate radiation striking zone, for example as indicated in a video game, as described below. For example, a signal may be sent from the base module 102 (e.g., using a transmitter) to a receiver of the striker when the correct radiation striking zone is struck, which may then trigger vibration of the feedback mechanism 210. Other configurations and manners of providing force feedback via the striker are also possible, and various aspects described herein relating to strikers are not limited to the strikers providing any type of force feedback.

The transmitter signal transmitted by transmitter 202 (e.g., output signal 356) may be of any suitable type and may include any suitable information. For instance, the transmitter signal may be an analog signal or a digital signal. According to one embodiment, the transmitter signal may include no information other than the signal itself, i.e., the presence of the signal may be the only information transmitted to the receivers 104*a*-104*d*. According to another embodiment, the signal output by the transmitter 202 may include information about such things as the identity of the striker generating the transmitted signal, an indication of the degree of acceleration of the striker, and/or an indication of the direction of motion of the striker, among other things. Information about the identity of the striker generating the transmitted signal may be useful, for example, in interacting with a video or music game, since such games may require that a particular striker be used for striking a particular radiation zone. Also, distinguishing between which striker is used for a particular strike may increase the realism of playing the simulated percussive instrument and may thereby also increase the educational or training capability of the electronic game component. According to one embodiment, a code identifying the striker is transmitted as at least part of the transmitter output signal. The code made be stored in a PIC processor or memory of the striker or in any other suitable manner. As mentioned previously, information about the degree of acceleration may be used, for example, in determining the volume of a sound to be generated in response to the strike, or for other uses.

In those embodiments in which the signal transmitted by transmitter 202 includes information, such information may be in any suitable form. According to one embodiment, the transmitter signal transmits data packets that include information identifying the striker generating the transmitter signal as well as identifying a degree of acceleration (or velocity or other characteristic of motion) of the striker. According to one embodiment, the data packets may include between two and eight bits, although other bit lengths are also possible. According to one embodiment, the packets may include five bits, for example with one bit indicating which striker is transmitting the signal (e.g., the bit may indicate either a left striker or a right striker) and a four bit value identifying the detected velocity or acceleration of the striker. As will be described further below, the information about the identity of the striker and the degree of acceleration of the striker may be used by processing circuitry of the base module 102 to determine an appropriate response to be generated upon receipt of the transmitter signal by one of the receivers 104*a*-104*d*.

The striker 114*a* may be powered in any suitable manner. In one embodiment, a wireless power source may be employed. As shown in FIG. 2, in one embodiment the striker may be battery-powered and may include a battery compartment 206, e.g., for holding two AAA batteries or any number of batteries of any other size and type. According to another embodiment, the striker may be wired to a power source (e.g., a wall outlet), the base module 102 (through which power may be provided), or any other suitable power source. Thus, it should be appreciated that strikers according to the various embodiments described herein may be powered in any suitable manner, and are not limited with respect to the manner in which they are powered.

As also shown in FIG. 2, a striker may include a light emitting diode (LED) indicator 208. The LED indicator may indicate the status of the striker. For example, a solid light may indicate the striker is on and in use, a blinking light may indicate the battery power of the striker is low (in those embodiments in which the striker is battery powered), and no light may indicate the striker is off or in sleep mode. However, these are non-limiting examples of status indications corresponding to the status of the striker. Other forms and types of indications may also be provided, and not all embodiments described herein as including one or more strikers are limited to providing any status indication with respect to the strikers.

As mentioned previously, the signals transmitted by transmitter 202 may be directional in some embodiments, rather than being emitted in all directions from the striker 114*a*. In such embodiments, a user may need to orient the striker 114*a* suitably within a radiation striking zone if the receiver corresponding to the radiation striking zone is to receive any signal transmitted by the transmitter. According to one embodiment, the striker may be designed to facilitate holding of the striker by a user in a suitable orientation. For example, the housing 201 of the striker may include a notch, thumb-mold, hand-mold, groove, and/or other feature indicating the orientation in which the striker is to be held by the user to ensure that the transmitter transmits its signal toward the receivers of the electronic game component 100.

In addition, as has been mentioned, according to one aspect of the present invention an electronic game component includes multiple strikers, such as strikers 114*a* and 114*b*, each of which is uniquely identified. The ability to distinguish between strikers may be useful for various reasons. For example, the electronic game component may be used to interact with a video or music game which requires a particular striker to be used for a particular motion, for example to simulate or evaluate right hand and left hand drumming techniques. Accordingly, each of the strikers may include an indication of which striker it is, such as a left or right striker. The indication may be provided in any suitable manner. For example, the strikers may be color-coded (e.g., blue for a striker to be held in the user's right hand and green for a striker to be held in the user's left hand). Alternatively, an indication identifying the striker may be printed on the housing, such as the letters "L" and "R" for left and right, respectively. Other schemes for indicating to a user which striker is which may be used. Also, it should be appreciated that not all embodiments are limited to distinguishing between strikers used with the electronic game component. For example, according to one embodiment two or more strikers used in connection with an electronic game component may be treated equally in terms of which striker is used to strike in a particular radiation striking zone at a particular time, such that a user may not need to differentiate the strikers from each other.

Figure 4:
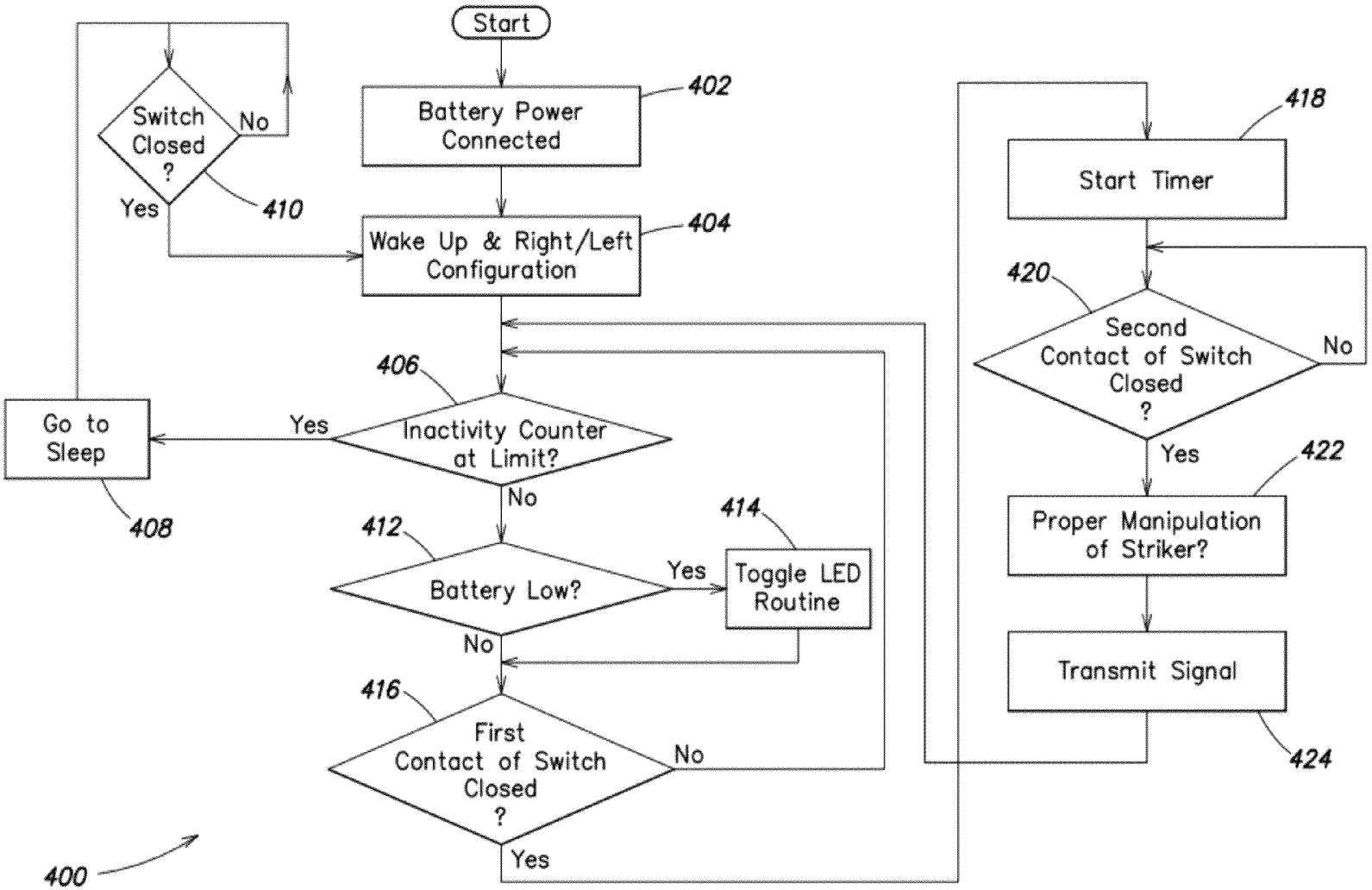
FIG. 4 is a flowchart illustrating a non-limiting example of the operation of the striker of FIG. 2, according to one embodiment of the present invention.

FIG. 4 illustrates a method of operation of a striker according to an embodiment of the present application. As shown, the method 400 begins at step 402, where power to the striker is provided by, for example, a battery or by a wired connection. Thus, at step 404, the striker wakes up, and any necessary configuration of the striker, for example, as either a left striker or a right striker, may be performed in any suitable manner. For example, the strikers may be configured by a user toggling a switch to indicate in which hand the user is holding each striker, or in any other suitable manner. Subsequently, at decision step 406, it is determined whether the striker has been inactive for a threshold amount of time. If so, the striker may enter a sleep mode at step 408 to conserve power.

If the striker enters sleep mode at step 408, it may be woken up by swinging the striker to close the motion detection switch 204. At decision step 410, it is determined whether the motion switch has been closed (e.g., whether the spring 308 has contacted either of the contact portions 307*a* or 307*b*). If not, the striker remains in sleep mode and decision step 410 is repeated, for example, at periodic intervals. If the motion switch has been closed, the method returns to step 404, where the striker is woken up and any necessary configuration of the striker is performed.

If, at decision step 406, it is determined that the striker has not been inactive for the threshold duration of time, a query is performed at decision step 412 as to the level of the battery strength. If the battery strength is low, an LED routine may be performed at step 414 to indicate to the user the battery strength is low. If, at decision step 412, it is determined that the battery is not low, the method may proceed to decision step 416.

At decision step 416, a determination is made as to whether the spring of the motion switch has made contact with one of the contact portions 307*a* or 307*b*. If contact has not been made, the method returns to decision step 406. In this manner, steps 406 and 412 may be repeated in a loop until it is determined at decision step 416 that the spring of the motion has made contact with one of the contact portions 307*a* or 307*b*. If, at decision step 416, contact has been made, a timer may be started at step 418.

At decision step 420, a determination is made as to whether the other contact portion (307*a* or 307*b*) of the motion switch has been contacted. If not, the method repeats the decision step 420. If, on the other hand, it is determined at decision step 420 that the other of the contact portions has been contacted, the method may proceed to step 422, at which a determination may be made whether the time duration between contacts of the contact portions 307*a* and 307*b* indicates proper manipulation (e.g., suitable acceleration) of the striker, for example using the techniques described above with respect to FIGS. 3A and 3B. If proper manipulation is indicated, a signal may be transmitted at step 424 by the transmitter of the striker. The method may then return to step 406.

According to one embodiment, the method 400 may only perform decision step 420 a limited number of times before returning, for example, to decision step 416. In some instances one of the contact portions 307*a* or 307*b* may be contacted at decision step 416, but subsequent manipulation of the striker may not be sufficient to cause the other of the contacts to be contacted during a particular swing. Accordingly, a time duration between possible contacts of contact portions 307*a* and 307*b* may be used to determine whether contacts of contact portions 307*a* and 307*b* are associated with a single swinging or striking motion. If the time duration (e.g., 2 seconds) is exceeded after decision step 416, the method may return to decision step 416 assuming that any subsequent contact of either contact portion 307*a* or 307*b* represents a distinct swing or strike. However, not all embodiments are limited in this respect.

It should be appreciated that the method 400 is a non-limiting example of a method of operation of a striker according to one embodiment of the present invention. Other methods are possible, and the given method chosen may depend on the type of striker. Further, the method may be performed using any suitable combination of hardware, firmware, and/or software. According to one embodiment, the processing steps of the method 400 may be performed by processor 212, although other manners for performing the routine are also possible.

The signals transmitted by strikers 114*a* and 114*b* may be received by the receivers 104*a*-104*d* and processed to generate any suitable response. The type of response generated may depend on the manner in which the electronic game component is being used. According to one embodiment, the electronic game component 100 may be used as a stand-alone item capable of generating musical sounds (and optionally visual cues) in response to strikes within the radiation striking zones. In this manner, the electronic game component may operate as virtual instrument, for example being capable of simulating a drum kit or any other percussive instrument. According to another embodiment, the electronic game component may interface with an audio generator, such as an audio amplifier, which may produce audio output (e.g., musical sounds) in response to strikes within the radiation striking zones. According to another embodiment, the electronic game component 100 may be used in combination with a gaming console (e.g., a video game console, such as an Xbox 360® from Microsoft® Corporation, Playstation® from Sony®, PS3® from Sony®, a Wii® from Nintendo® or any other gaming console), and thus may operate as an input device for the gaming console. In such an embodiment, strikes within the radiation striking zones may trigger any desired response programmed for a game played on the console, as aspects of the invention are not limited in this respect. Examples of actions may include playing musical sounds, interacting with a musical game (e.g., a game in which the user plays along to music displayed on a video screen), controlling a character within a video game, and navigating menu options of a video game, among others. According to one embodiment, the electronic game component may be capable of operating in multiple of the modes just described, and the particular mode of operation at any given time may be, for example, selected by a user.

Figure 5:
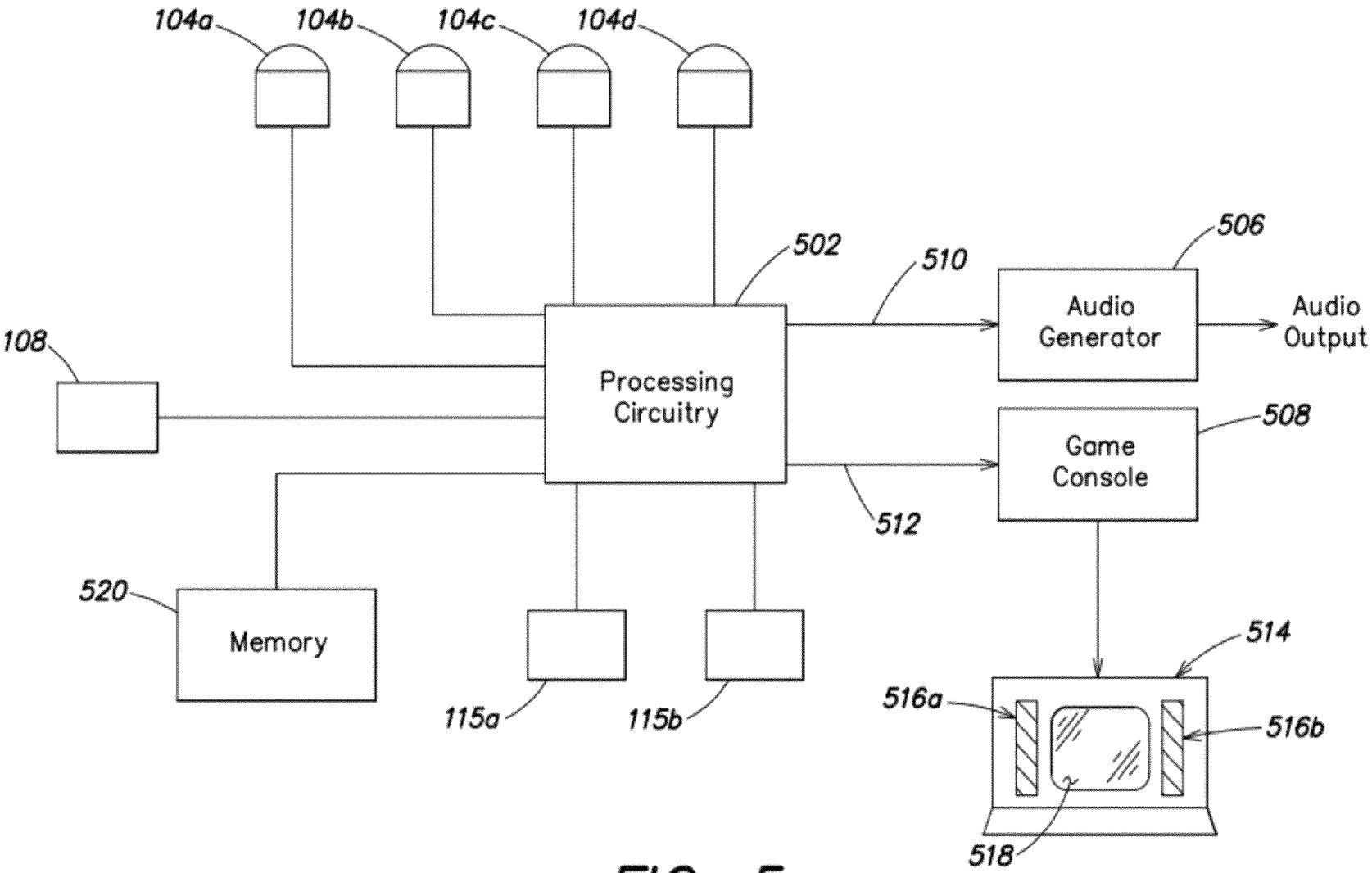
FIG. 5 illustrates an electrical configuration of processing circuitry of the electronic game component of FIGS. 1A and 1B, according to one non-limiting embodiment of the present invention.

According to one embodiment, the electronic game component 100 includes processing circuitry for processing output signals of the detectors of receivers 104*a*-104*d* in a manner suitable for using the electronic game component in any of the above-described modes. According to one embodiment, the processing circuitry may be in the base module 102, but is not visible in FIGS. 1A and 1B since it may be inside the base module. FIG. 5 illustrates one non-limiting suitable configuration for processing circuitry of the electronic game component 100, which may be part of the base module 102.

As shown, the processing circuitry 502 may have inputs coupled to each of the receivers 104*a*-104*d* to receive signals output by the detectors of those receivers in response to the detectors receiving signals from a striker. Depending on the types of signals transmitted by the striker, the processing circuitry may process them in any suitable manner. For example, if the signals do not include any information, and represent only that a strike has occurred, then the processing circuitry 502 may operate on them in a first manner. On the other hand, if the signals transmitted by a striker include other information (e.g., identifying the striker, indicating the degree of acceleration of the striker, indicating a direction of motion of the striker, etc.), the processing circuitry may operate on the signals it receives from the detectors of receivers 104*a*-104*d* in a manner suitable for determining the information included in the transmitter signals. The processing circuitry may be configured to process the signals sufficiently quickly to detect distinct strikes occurring close in time to each other. For example, the processing circuitry may be configured to process distinct strikes occurring within 100 milliseconds of each other, within 50 milliseconds of each other, or within 30 milliseconds of each other, as non-limiting examples. Such processing capabilities may allow the user to strike the radiation striking zones at frequencies which may be expected when playing a simulated percussive instrument.

The processing circuitry may be configured to output control signals 510 and/or 512 in response to processing the signals received from the receivers 104*a*-104*d*. The control signals 510 may be audio control signals, controlling the generation of an audio output by an audio generator 506. The audio generator may be any suitable audio generator and include any suitable audio processing circuitry, such as an audio amplifier, one or more filters, and a speaker. According to one embodiment, the audio generator may be part of the electronic game component 100 (e.g., within base module 102). According to an alternative embodiment, the audio generator may be distinct from the electronic game component 100. For example, according to one embodiment the base module may be plugged into a conventional audio amplifier as might be used for connecting to an electric guitar. However, other forms of audio generators may be used, and the various embodiments described herein are not limited to using any particular type of audio generator.

The audio control signals 510 may take any suitable form for controlling generation of audio output by the audio generator 506. As a non-limiting example, the audio control signals 510 may be MIDI signals, or substantially similar to MIDI signals, in one non-limiting embodiment. According to one embodiment, the audio control signals 510 indicate a type of sound to be generated, a volume at which to generate the sound, the timbre of the sound, and the duration of the sound. These are non-limiting examples, as any other information relevant to the generation of sound by the audio generator 506 may be provided in control signals 510.

For example, according to one embodiment, the audio generator 506 may store sampled sounds in a masked ROM, for example with different ones of the samples corresponding to different volumes. As a non-limiting example, the masked ROM may store a file (e.g., a 16 bit .wav file, or any other suitable file type) for a quiet snare sound, a separate file for a medium snare sound, and a separate file for a loud snare sound. The processing circuitry 502 may decode any information in a received transmitter signal with respect to velocity or acceleration, and the resulting audio control signal 510 may trigger playback of the appropriate file in the masked ROM, in terms of sound and volume. According to an alternative embodiment, the processing circuitry itself may store the files and the audio control signals 510 may include one or more of the files to be played by the audio generator.

According to one embodiment, strikes made within a particular radiation striking zone may trigger generation of a particular sound. For example, referring to FIG. 1B, the electronic game component may be configured to simulate a drum kit, with the strikes inside radiation striking zone 110*a* generating a sound corresponding to a crash cymbal, strikes within radiation striking zone 110*b* generating a sound corresponding to a tom, strikes within radiation striking zone 110*c* generating a sound corresponding to a snare, and strikes within radiation striking zone 110*d* generating a sound corresponding to a ride cymbal. Thus, an audio control signal 510 generated by the processing circuitry 502 may include an indication of the type of sound to be generated in dependence on which of the receivers 104*a*-104*d* detected a strike within the corresponding radiation striking zone. For example, as mentioned, according to one embodiment the audio generator 506 may store sampled sounds (e.g., as .wav files) and the audio control signal 510 may trigger playback of the appropriate file for a given radiation striking zone that was struck. Alternatively, the processing circuitry 502 itself may store the files and the audio control signal 510 may include one or more files to be played by the audio generator.

It should be appreciated that the number and types of listed sounds corresponding to the radiation striking zones are merely non-limiting examples, as the sound generated may depend on whether the electronic game component is being used to simulate a particular percussive instrument. For example, if the electronic game component is being used to simulate a drum kit with a crash cymbal, the radiation striking zone 110*a* may correspond to a crash cymbal, as described. However, if the electronic game component is being used to simulate a drum kit without a crash cymbal, the radiation striking zone 110*a* may correspond to a different component of the simulated drum kit. Similarly, if the electronic game components is being used to simulate a xylophone, the radiation striking zone 110*a* may correspond to a sound generated by a particular component of the xylophone. Thus, it should be appreciated that the radiation striking zones may be used to correspond to various components of a simulated instrument in those embodiments in which the electronic game component is being used to simulate an instrument. Furthermore, not all embodiments are limited to generating sounds indicative of a simulated percussive instrument. For example, striking within a particular radiation striking zone may generate a series of musical notes, may trigger playing a riff, a song, or other form of sound. Also, as will be described further below, sound need not be generated in all embodiments in response to striking in a radiation striking zone.

In addition, the response associated with striking within a particular radiation striking zone may be variable, either between uses of the electronic game component or during a single use. For example, according to one embodiment the processing circuitry may be provided an indication (e.g., from memory 520, which may be in the base module 102 or elsewhere) of the response associated with a particular radiation striking zone, and such indications may be updated by reprogramming the data in the memory. For example, the user may insert a card (e.g., a USB compatible card) into the base module 102 which may provide the processing circuitry with an indication of what response to take when a particular radiation striking zone is struck. Thus, by switching the cards or taking some other action, the user may alter the types of responses which may be generated.

As explained above, the signals transmitted by a striker may also include information indicating some characteristic of the striker, such as an identification of the striker and a degree of acceleration. According to one embodiment, the processing circuitry 502 may process any signals from receivers 104*a*-104*d* to determine an indicated acceleration and produce corresponding audio control signals 510 indicating a particular volume of sound to be generated based on the indicated acceleration. However, information about the striker identity and motion may be used in any suitable manner, as volume control is merely one non-limiting example.

Thus, it should be appreciated from the foregoing that the audio control signals 510 may take any suitable form and include any suitable information for interacting with the audio generator 506.

As mentioned, according to one aspect of the present invention an electronic game component as described herein may be used in connection with a video gaming console, such as an Xbox 360® from Microsoft® Corporation, Playstation® from Sony®, PS3® from Sony®, a Wii® from Nintendo® or any other gaming console. A non-limiting example is shown in FIG. 5, in which the processing circuitry 502 is coupled to the game console 508. The game console may itself be coupled to a device 514, such as a television or other device, comprising speakers 516*a* and 516*b* and a display screen 518. According to this aspect, the electronic game component may operate as an input device to the game console 508 by providing gaming control signals 512.

The gaming control signals 512 may be generated by processing circuitry 502 in response to strikes within the radiation striking zones defined by the electronic game component, and may be of any suitable type for interacting with the game console 508, such as the types of control signals that would be provided by other input devices to those gaming consoles. For example, the gaming control signals may include Boolean on/off signals, corresponding to signals provided by buttons of some gaming input devices, as well as multi-bit digital values, for example corresponding to a detected velocity or acceleration of a striker. These are non-limiting examples, however, as the aspects described herein relating to using the electronic game components in combination with a game console are not limited to the gaming control signals 512 taking any specific format.

The gaming control signals 512 may be used to trigger various types of responses. For example, various manners in which a guitar-shaped controller may be used to interact with a video game console, and various types of game play, are described in U.S. Patent Publication No. 2009/0191932, which is hereby incorporated herein by reference in its entirety. Any of the manners of interacting with a video game console described therein, and the types of game play described therein, may be applied to the use of the electronic game components described herein.

According to one embodiment, the gaming control signals 512 may be used to trigger the generation of sound, which, for example, may be presented to a user via the speakers 516*a* and 516*b*. In such instances, the control signals 512 may provide an indication to the game console 508 of the type of sound to be generated, the volume, the timbre, the duration, or any other suitable parameter of the sound.

According to one embodiment, the electronic game component 100 may be used to interact with a game of the game console in a manner other than, or in addition to, the generation of sound. For example, according to one embodiment, striking within the radiation striking zones 110*a*-110*d* may control movement of a character in a video game displayed on the display 518. As non-limiting examples, suitably striking within appropriate ones of the radiation striking zones may cause a character to run, jump, stand up, or perform any other task. Accordingly, the control signals 512 may be of a suitable type and form for indicating to the game console 508 the action to be taken by the video game character.

According to another embodiment, striking within the radiation striking zones of the electronic game component 100 may also, or alternatively, be used to configure a video game of the game console 508, for example by selecting game options, game settings, player options, game levels, or other characteristics of a game being played. Thus, for example, the control signals 512 may be of a type and form suitable for navigating menu options displayed on the display 518, according to one embodiment.

Thus, it should be appreciated that the electronic game components described herein need not be used solely to produce audio signals, or to produce audio signals at all. Rather, according to some embodiments the electronic game components simulating percussive instruments described herein may be used to provide the full functionality of an input device interacting with a game console 508.

It should be appreciated that the processing circuitry may take any suitable form. According to one embodiment, the processing circuitry may comprise a microcontroller or microprocessor programmed with processor-executable instructions which, when executed, cause the processor to process the input signals received from the receivers 104*a*-104*d*. According to another embodiment, the processing circuitry may include a field programmable gate array (FPGA) or an application specific integrated circuit (ASIC). According to one embodiment, the processing circuitry may be an integrated processor, whereas in other embodiments the processing circuitry may be formed of distributed circuitry (e.g., distinct circuits coupled to each of the receivers 104*a*-104*d*). Thus, it should be appreciated that the particular type and configuration of processing circuitry for processing signals from the receivers 104*a*-104*d* and providing control signals is not limiting.

As illustrated in FIGS. 1A and 1B, the electronic game component 100 further comprises indicators 106*a*-106*d* in the base module 102. The indicators 106*a*-106*d* may indicate when a strike is detected within the corresponding radiation striking zone. Thus, the indicators 106*a*-106*d* may take any suitable form, and in one embodiment each comprises an LED emitter for providing a visual indication to a user that a strike was detected. In this manner, a user of the electronic game component 100 may be provided with a visual indication of whether he or she has correctly struck within one of the plurality of radiation striking zones, which may facilitate teaching or training of the user in use of a percussive instrument. According to one embodiment, an indication of correct striking may be based on whether an appropriate one of the radiation striking zones was struck, while in an alternative embodiment an indication may be provided if any of the radiation striking zones is struck. Other schemes for the operation of the indicators are also possible, and not all embodiments described herein include indicators 106*a*-106*d*.

As also shown in FIGS. 1A and 1B, the electronic game component may further comprise control buttons 108, which may be within the base module 102. The control buttons 108 may allow a user to navigate through menu options or otherwise control the electronic game component 100 and/or a corresponding audio generator 506 or game console 508. For example, the control buttons 108 may include a directional selection switch 109, which may allow the user to navigate through menu options applicable to the electronic game component 100 (e.g., for selecting a particular sound to be associated with a particular radiation striking zone). Similarly, control buttons 111 and 113 may enable a user of the electronic game component 100 to select menu options or otherwise interact with the electronic game component. According to one embodiment, one or more of the control buttons 108, such as control buttons 111 and 113, may be specific control buttons for use with a particular type of game console 508. For example, if the game console 508 is an Xbox 360®, the control buttons 111 and 113 may correspond to the control buttons of an Xbox 360® (e.g., the "X" "Y" "A" and "B" buttons). Thus, it should be appreciated that the control buttons 108 may be of any suitable type and take any suitable form, and in some embodiments there may not be any at all.

According to one embodiment, output signals of the control buttons 108 may be processed by processing circuitry of the electronic game component 100. For example, as shown in FIG. 5, the processing circuitry 502 may be coupled to the control buttons to receive and process output signals of the control buttons and generate any suitable response. According to one embodiment, the output signals of the control buttons may trigger the processing circuitry 502 to generate suitable audio control signals 510 and/or gaming control signals 512. According to an alternative embodiment, the control buttons may be directly connected to an audio generator (e.g., audio generator 506) and/or game console (e.g., game console 508), rather than providing their output signals to the processing circuitry 502. According to one embodiment, output signals of the control buttons 108 may be used internally by the electronic game component (e.g., to program settings of the base module) and may not be provided to an audio generator or game console or used to trigger the generation of control signals to an audio generator or game console.

As previously mentioned with reference to FIG. 1A, the electronic game component 100 further comprises foot pedals 115*a* and 115*b*, which may be connected, wirelessly or via respective cables 117*a* and 117*b*, to input ports 112*a* and 112*b* of the base module. The foot pedals may be provided to further simulate a percussive instrument, either when the electronic game component is used as a stand-alone instrument or when the electronic game component operates in combination with a game console. For example, in those embodiments in which the electronic game component 100 is used to simulate a drum kit, the foot pedals may be manipulated by a user to generate sounds corresponding to a bass drum, a hi-hat, or other components of a drum kit which may conventionally be played using a foot pedal. Thus, the electronic game component 100 may provide a realistic simulation of playing an actual drum kit, which may enhance a user's enjoyment as well as the educational/training capabilities of the electronic game component. However, it should be appreciated that the foot pedals 115*a* and 115*b* are not limited to generating any particular sound, or even sound at all. For example, they may be used to control a character of a video game on game console 508, among other uses. In addition, in some embodiments, foot pedals may not be included.

As shown in FIG. 5, in one embodiment the foot pedals 115 and 115*b* may be coupled to the processing circuitry 502 to provide output signals to the processing circuitry. The processing circuitry may then generate suitable audio control signals 510 and/or gaming control signals 512. Other electrical configurations for the foot pedals 115*a* and 115*b* are also possible.

Figure 6:
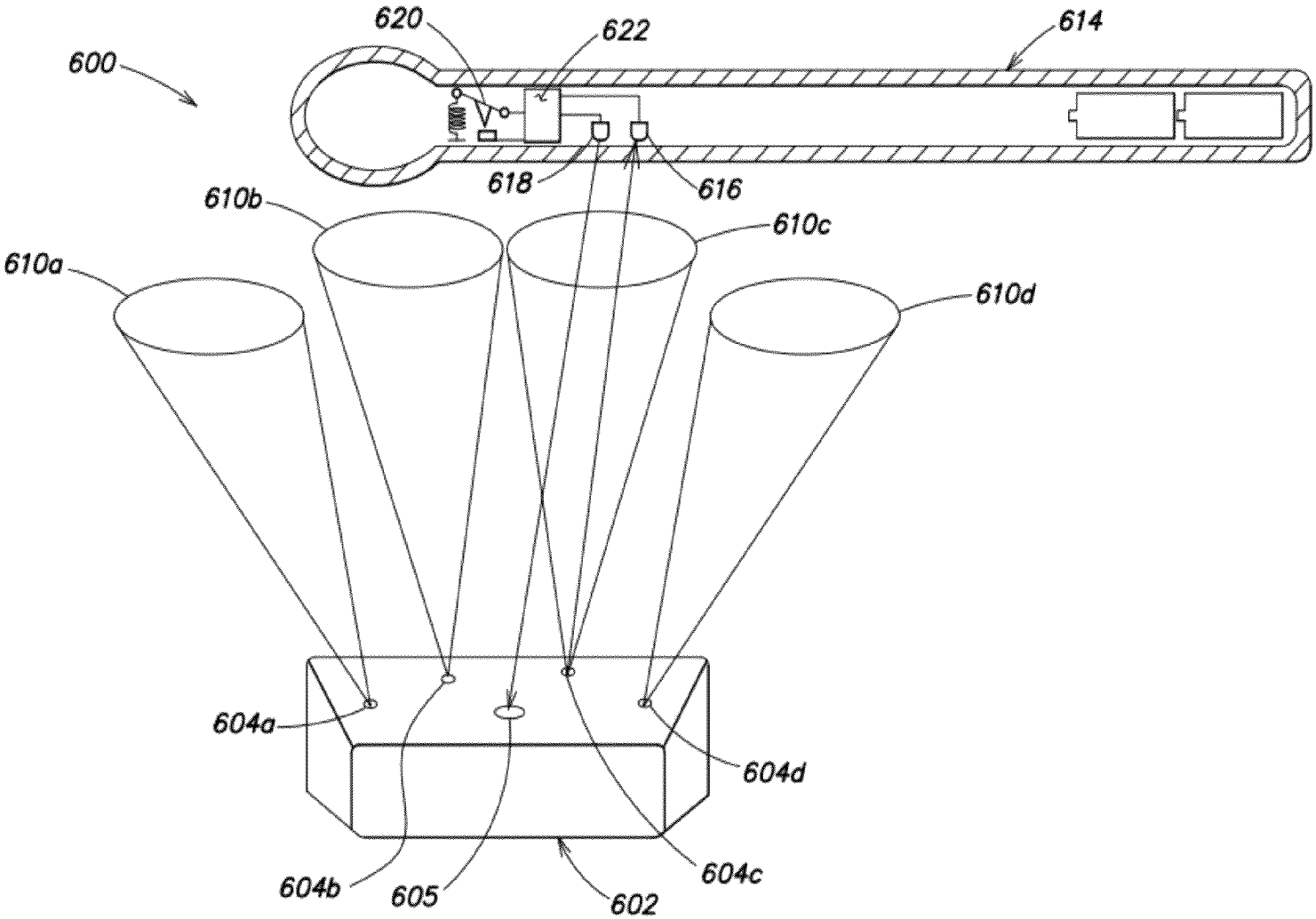
FIG. 6 illustrates an alternative embodiment of an electronic game component, in which the electronic game component includes a plurality of transmitters defining a plurality of radiation striking zones.

FIGS. 1A and 1B illustrate one non-limiting example of an electronic game component defining a plurality of radiation striking zones, in which the radiation striking zones are defined by receivers in a base module. It should be appreciated that alternatives are possible. For example, according to one embodiment an electronic game component comprises a base module defining a plurality of radiation striking zones using transmitters. FIG. 6 illustrates an example.

As shown, the electronic game component 600 comprises a base module 602 comprising a plurality of transmitters 604*a*-604*d*. Each of the transmitters 604*a*-604*d* may define a corresponding radiation striking zone 610*a*-610*d* by transmitting any suitable type of signal (e.g., IR radiation, any of the types of radiation described above in connection with the receivers 104*a*-104*d* and the transmitter 202, or other types of signals). The base module 602 also comprises a receiver 605 for receiving signals from a striker. Although not shown in FIG. 6 for simplicity, the electronic game component 600 may further comprise foot pedals, control buttons, and indicators such as those of electronic game component 100.

The electronic game component 600 may be used with a different type of striker than strikers 114*a* and 114*b*. For example, as shown in FIG. 6, a striker 614 may be used, including both a receiver 616 and a transmitter 618. The receiver 616 may be of any suitable type (e.g., an IR detector) for receiving the radiation transmitted by the transmitters 604*a*-604*b* when the striker 614 is suitably positioned within one of the radiation striking zones 610*a*-610*d*. The transmitter 618 of striker 614 may transmit a signal (e.g., an IR signal) detectable by receiver 605 of the base module 602.

According to one embodiment, the striker 614 may be configured to transmit a signal only when the striker is manipulated in a suitable striking motion, as previously described with respect to striker 114*a*. For example, as shown in FIG. 6, the striker 614 may similarly include a motion switch 620, for example, to detect the acceleration/deceleration of the striker 614. According to one embodiment, the transmitter 618 is only enabled to transmit a signal when the motion switch indicates the striker has been sufficiently accelerated/decelerated, as described previously with respect to striker 114*a*, and when the receiver 616 receives a signal from one of the transmitters 604*a*-604*d*, thus indicating the striker is positioned within one of the radiation striking zones 610*a*-610*d*. However, other manners of operation of the striker 614 may be used, as this is merely one non-limiting example.

Various schemes may be used for determining in which of the radiation striking zones 610*a*-610*d* the striker 614 is positioned when the transmitter 618 transmits a signal. According to one embodiment, a coding scheme may be implemented. According to this embodiment, each of the plurality of transmitters 604*a*-604*d* may transmit a unique coded signal. According to one embodiment, the striker receives the coded signal of the transmitter 604*a*-604*d* when positioned in the corresponding radiation striking zone and then re-transmits the same code from the transmitter 618 back to the receiver 605 of the base module 602. For example, the striker may include a repeater circuit 622. In such an embodiment, the base module receives the code and may identify which of the plurality of transmitters generated the code, and thereby in which of the plurality of radiation striking zones the striker was located when the strike was made.

According to another implementation, the striker may receive the coded signal from one of the transmitters 604*a*-604*d* when positioned within the corresponding radiation striking zone, may process the coded signal, and then may transmit (using transmitter 618) a return signal to the receiver 605 that identifies the code which it received from the base unit, again providing the base module with an indication of the radiation striking zone in which the striker was located when the strike was made.

According to an alternative implementation, a time division multiplexing scheme may be utilized to determine in which of the plurality of radiation striking zones the striker 614 was located when transmitting a signal to receiver 605. According to this embodiment, the plurality of transmitters 604*a*-604*d* may transmit their signals at different times (e.g., sequentially, or in any other suitable order). Thus, the receiver 616 may only receive a signal from one of the transmitters 604*a*-604*d* when the striker is suitably positioned within the corresponding radiation striking zone and when the corresponding transmitter 604*a*-604*d* is excited (i.e., transmitting). Thus, if the receiver 605 receives a signal from transmitter 618 of striker 614, a determination may be may as to which of the transmitters 604*a*-604*d* was actively transmitting at that time, and therefore in which of the radiation striking zones the striker 614 was located.

Other schemes for determining in which of the radiation striking zones 610*a*-610*d* the striker 614 is located may also be used, as the various embodiments relating to use of an electronic game component of the type illustrated in FIG. 6 are not limited to using any particular scheme.

The signals transmitted by transmitter 618 may take any of the forms previously described with respect to striker 114*a*. For example, in some embodiments the signals transmitted by transmitter 618 contain no information. In other embodiments, the signals transmitted by transmitter 618 may contain any of the types of information previously described with respect to signals transmitted by transmitter 202.

Also, it should be appreciated that the electronic game component 600 may be used in any of the modes previously described with respect to electronic game component 100, including as a stand-alone item, in combination with an audio generator, in combination with a gaming console, etc.

It should also be appreciated that electronic components according to the aspects described herein may take various forms. For example, the form illustrated in FIGS. 1A and 1B, in which a single housing includes the receivers 104*a*-104*d* is one non-limiting example. According to an alternative embodiment, each of the receivers 104*a*-104*d* may be formed within an individual housing, or within a removable component of the housing 102, such that each of the receivers 104*a*-104*d* may be positioned independently of the other by the user. In this manner, the user may position the receivers to position the radiation striking zones in any desired manner.

Also, the shape of the base modules 102 and 602 is non-limiting. For example, as shown, the receivers 104*a*-104*d* and transmitters 604*a*-604*d* may be positioned in a substantially horseshoe shape. Alternatively, they may be substantially in-line, or form a circle. Other configurations are also possible.

According to one embodiment, an electronic game component according to the various aspects described herein may be configured (e.g., sized and weighted) to form a portable device. For example, referring to FIG. 1A, the housing 102 of the electronic game component 100 may have a total length less than approximately twenty inches, less than approximately sixteen inches, or any other suitable value. In this manner, the housing may be compact, and depending on the materials used, may also be lightweight (e.g., under ten pounds), therefore allowing a user to easily move the housing 102 to a desired location. According to one embodiment, the plurality of radiation striking zones defined by the receivers 104*a*-104*d* of the electronic game component 100 may define a total surface area at a particular distance from the housing 102 that is larger than the surface area of the housing 102, as shown in FIG. 1C.

Figure 7B:
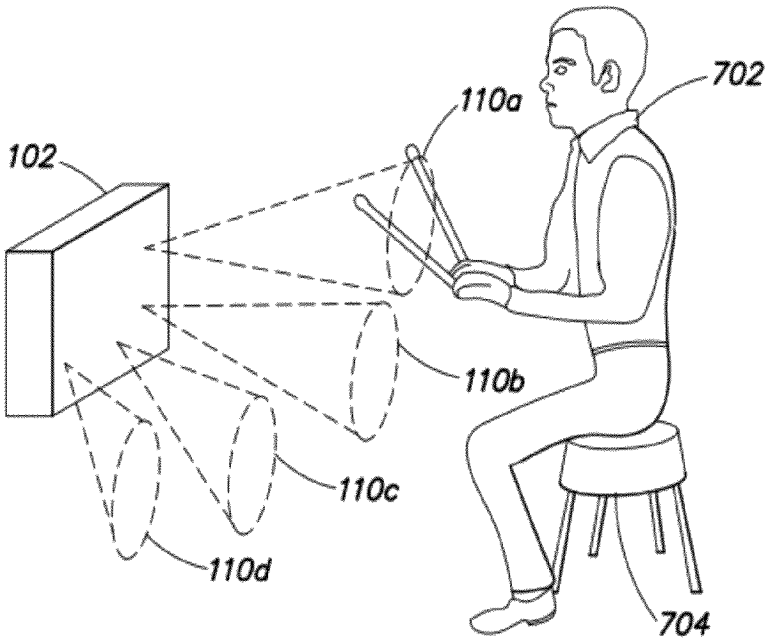
FIGS. 7A and 7B illustrate alternative configurations of a base module of an electronic game component according to the various aspects of the invention described herein.
Figure 7A:
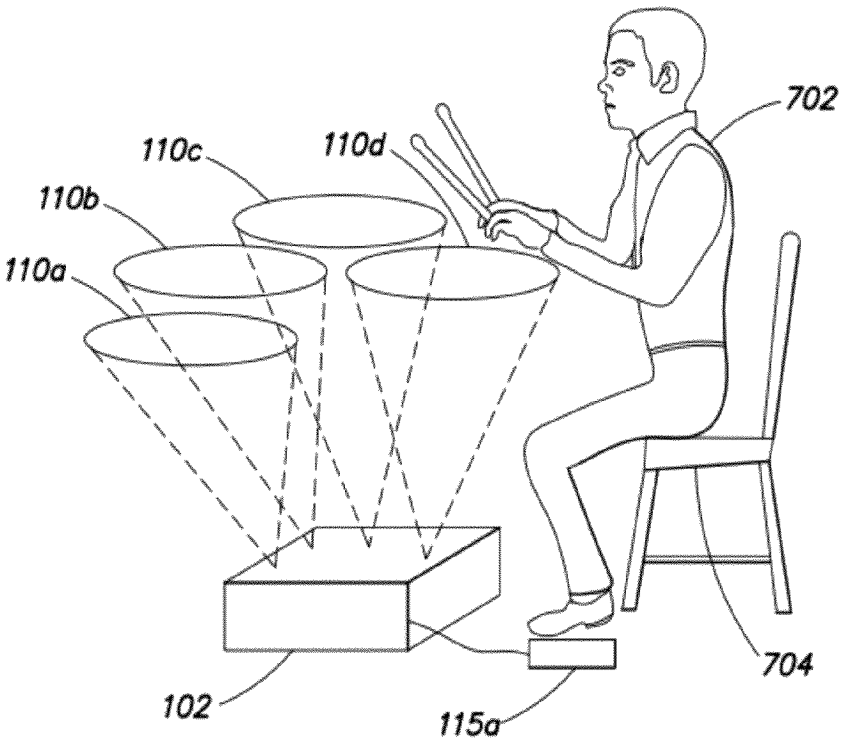

The electronic game components described herein may be positioned in any suitable manner. For example, the base modules 102 and 602 may be positioned on the floor. Thus, according to a first embodiment, the base module 102 of the electronic component may be positioned on the floor such that a user may interact with the base module by sitting in a chair and using the strikers 114*a* and 114*b*. An example is illustrated in FIG. 7A. As shown, the radiation striking zones may be projected substantially vertically from the floor, on which the base module 102 is placed, such that they may be positioned in front of a user 702 sitting in a chair or throne 704. The radiation striking zones may be defined such that they have a desired cross-sectional area at a height corresponding substantially to that at which it is expected the user sitting in the chair 704 will make striking motions (e.g., twenty-four inches from the base module, thirty-six inches from the base module, or any other suitable height). The user may, however adjust the height of the chair to facilitate use of the electronic game component 100.

According to an alternative embodiment, the base modules 102 and 602 may be mounted to a wall. FIG. 7B provides a non-limiting example with respect to base module 102. In this embodiment, the radiation striking zone may be projected from the base module 102 toward the user 702, who may either be sitting in the chair 704, standing, or otherwise positioned in front of the base module.

It should be appreciated that FIGS. 7A and 7B illustrate only two non-limiting examples of suitable configurations of the base modules 102 and 602 of the electronic game components described herein. Other configurations are also possible.

Having thus described several aspects of the invention, it is to be appreciated various alterations, modifications, and improvements will readily occur to those skilled in the art. Such alterations, modifications, and improvements are intended to be within the spirit and scope of the aspects of the invention. Accordingly, the foregoing description and drawings are by way of example only.

For example, while many of the embodiments have been described as relating to drum kits, it should be appreciated that the various aspects of the present invention may apply equally well to other percussive instruments, such as hand drums, bongos, xylophones, timpani, marimba, or any other percussive instruments.

The above described embodiments of the present invention can be implemented in any of numerous ways. For example, the embodiments may be implemented using hardware, software or a combination thereof. When implemented in software, the software code can be executed on any suitable processor or collection of processors, whether provided in a single computer or distributed among multiple computers. It should be appreciated that any component or collection of components that perform the functions described above can be generically considered as one or more controllers that control the above-discussed functions. The one or more controllers can be implemented in numerous ways, such as with dedicated hardware, or with general purpose hardware (e.g., one or more processors) that is programmed using microcode or software to perform the functions recited above.

In this respect, it should be appreciated that one implementation of one or more of the embodiments of the present invention comprises at least one computer-readable storage medium (also referred to as a non-transitory computer readable medium) (e.g., a computer memory, a floppy disk, a compact disk, a DVD, a tape, etc.) encoded with a computer program (i.e., a plurality of instructions), which, when executed on a processor, performs the above-discussed functions of the embodiments of the present invention. The computer-readable storage medium can be transportable such that the program stored thereon can be loaded onto any computer resource to implement the aspects of the present invention discussed herein. In addition, it should be appreciated that the reference to a computer program which, when executed, performs the above-discussed functions, is not limited to an application program running on a host computer. Rather, the term computer program is used herein in a generic sense to reference any type of computer code (e.g., software or microcode) that can be employed to program a processor to implement the above-discussed aspects of the present invention.

The phraseology and terminology used herein is for the purpose of description and should not be regarded as limiting. The use of "including," "comprising," "having," "containing," "involving," and variations thereof, is meant to encompass the items listed thereafter and additional items.

The invention claimed is:

1. An electronic game component that simulates a percussion instrument, the percussion instrument comprising a plurality of percussion components, the electronic game component comprising:

at least one base module comprising a plurality of receivers, each receiver of the plurality of receivers defining a respective radiation striking zone representing a field of view of the receiver, wherein the plurality of receivers therefore defines a plurality of radiation striking zones, each radiation striking zone corresponding to one of the plurality of percussion components, wherein the plurality of radiation striking zones are arranged and sized to simulate the plurality of percussion components, wherein the at least one base module is configured to project the plurality of radiation striking zones away from the at least one base module; and processing circuitry that, in response to detection of a strike by at least one striker in any of the plurality of radiation striking zones, generates at least one signal indicating in which of the plurality of radiation striking zones the strike was detected.

2. The electronic game component of claim 1, wherein the at least one base module comprises the processing circuitry.

3. The electronic game component of claim 1, wherein the at least one signal is a control signal for an electronic game console.

4. The electronic game component of claim 3 in combination with the electronic game console.

5. The electronic game component of claim 1, wherein the at least one signal controls generation of an audio output.

6. The electronic game component of claim 5, in combination with at least one speaker coupled to the processing circuitry to receive the at least one signal and configured to generate the audio output.

7. The combination of claim 6, wherein the at least one base module and the at least one speaker are integrated within a same housing.

8. The electronic game component of claim 1, wherein the percussion instrument is a drum kit and wherein the plurality of percussion components comprises a plurality of drum kit components, wherein the electronic game component further comprises the at least one striker, and wherein the at least one striker comprises a pair of strikers each sized, shaped and weighted to approximate a drum stick.

9. The electronic game component of claim 8, wherein the plurality of radiation striking zones do not intersect each other for at least approximately two feet from the at least one base module.

10. The electronic game component of claim 9, wherein the pair of strikers comprises a first striker and a second striker, and wherein the processing circuitry is configured to differentiate between strikes by the first and second strikers.

11. The electronic game component of claim 1, wherein at least one receiver of the plurality of receivers is configured to detect a strike by the at least one striker in at least one of the plurality of radiation striking zones.

12. The electronic game component of claim 11, wherein the electronic game component further comprises the at least one striker and at least one sensor configured to sense a characteristic of motion of the at least one striker, and wherein the at least one receiver of the plurality of receivers detects a strike by the at least one striker in the at least one of the plurality of radiation striking zones only when the at least one sensor senses that the characteristic of motion achieves a threshold value.

13. The electronic game component of claim 12, wherein the characteristic of motion is acceleration, and wherein the at least one receiver of the plurality of receivers detects a strike by the at least one striker in the at least one of the plurality of radiation striking zones only when the at least one sensor senses that the at least one striker has been accelerated sufficiently to achieve a threshold acceleration.

14. The electronic game component of claim 13, wherein the at least one striker is configured to generate at least one trigger signal upon achieving the threshold acceleration.

15. The electronic game component of claim 14, wherein the at least one trigger signal identifies the at least one striker.

16. The electronic game component of claim 15, wherein the at least one trigger signal comprises multiple bits, and wherein at least one bit of the multiple bits identifies the at least one striker.

17. The electronic game component of claim 14, wherein the trigger signal is an infrared signal.

18. The electronic game component of claim 12, wherein the at least one sensor is disposed in the at least one striker.

19. An electronic game component that simulates a percussion instrument, the percussion instrument comprising a plurality of percussion components, the electronic game component comprising:

at least one base module comprising a plurality of receivers, each receiver of the plurality of receivers defining a respective radiation striking zone representing a field of view of the receiver, wherein the plurality of receivers therefore defines a plurality of radiation striking zones, each radiation striking zone corresponding to one of the plurality of percussion components, wherein the at least one base module is configured to project the plurality of radiation striking zones away from the at least one base module;

at least one striker comprising at least one sensor that senses when the at least one striker has been swung with a threshold value of a characteristic of motion, wherein each receiver of the plurality of receivers is configured to detect a strike by the at least one striker in the respective radiation striking zone, wherein the at least one receiver of the plurality of receivers detects the strike by the at least one striker in the respective radiation striking zone only when the at least one sensor senses that the at least one striker has been swung with the threshold value of the characteristic of motion; and processing circuitry that generates at least one control signal indicating in which of the plurality of radiation striking zones the strike was detected.

20. The electronic game component of claim 19, wherein the at least one base module comprises the processing circuitry.

21. The electronic game component of claim 19, wherein the at least one control signal controls generation of an audio output.

22. The electronic game component of claim 21, wherein the processing circuitry is coupled to a speaker to provide the at least one control signal to the speaker, and wherein the speaker generates the audio output.

23. The electronic game component of claim 22, wherein the at least one base module comprises the speaker.

24. The electronic game component of claim 21, wherein the audio output is of a type of a plurality of types, the type depending on the radiation striking zone of the plurality of radiation striking zones in which the strike was detected.

25. The electronic game component of claim 24, wherein each of the plurality of radiation striking zones is associated with a control signal of a type uniquely associated with that radiation striking zone.

26. The electronic game component of claim 25, wherein the plurality of types of control signals dictate the generation of different percussive sounds.

27. The electronic game component of claim 21, wherein the at least one sensor is configured to sense at least two degrees of the characteristic of motion, and wherein the at least one control signal controls a volume of the audio output in dependence on a sensed degree of the characteristic of motion.

28. The electronic game component of claim 19, wherein the characteristic of motion is acceleration.

29. The electronic game component of claim 19, wherein the at least one control signal is a control signal for an electronic game console.

30. An electronic game system that simulates a percussion instrument comprising a plurality of percussion components, the electronic game system comprising:

at least one base module comprising a plurality of receivers, each receiver of the plurality of receivers defining a respective radiation striking zone representing a field of view of the receiver, wherein the plurality of receivers therefore defines a plurality of radiation striking zones, each radiation striking zone corresponding to one of the plurality of percussion components, wherein the at least one base module is configured to project the plurality of radiation striking zones away from the at least one base module;

first and second strikers for striking the plurality of radiation striking zones; and processing circuitry configured to receive at least one detection signal indicating a strike by either of the first and second strikers in any of the plurality of radiation striking zones, the processing circuitry further configured to identify which of the first and second strikers was used in the strike and generate at least one control signal indicating in which of the plurality of radiation striking zones the strike was detected and by which of the first and second strikers.

31. The electronic game system of claim 30, further comprising:

at least a first sensor that senses when the first striker has been swung with at least a first predetermined value of a characteristic of motion of the first striker;

at least a second sensor that senses when the second striker has been swung with at least a second predetermined value of a characteristic of motion of the second striker, wherein the plurality of receivers are configured to detect a strike within the corresponding radiation striking zone by the first striker only when the first sensor senses that the first striker has been swung with at least the first predetermined value, and being further configured to detect a strike within the corresponding radiation striking zone by the second striker only when the second sensor senses that the second striker has been swung with at least the second predetermined value.

32. The electronic game system of claim 31, wherein the at least one detection signal is generated by one of the plurality of receivers.

33. The electronic game system of claim 31, wherein the characteristic of motion of the first striker is acceleration.

34. The electronic game system of claim 31, wherein the first striker comprises the first sensor.

35. The electronic game system of claim 30, wherein the processing circuitry is configured to provide the at least one control signal to an electronic game console.

36. The electronic game system of claim 35 in combination with the electronic game console, wherein the electronic game console is programmed with processor-executable instructions which cause it to compare the at least one control signal to a target input signal, and to provide feedback to a user of the electronic game system in dependence on how the at least one control signal compares to the target input signal.

37. A drum kit console that simulates a drum kit comprising a plurality of percussion components, the drum kit console comprising:

first and second sticks;

at least one base module comprising a plurality of receivers, each receiver of the plurality of receivers defining a respective radiation striking zone representing a field of view of the receiver, wherein the plurality of receivers therefore defines a plurality of radiation striking zones, each radiation striking zone corresponding to one of the plurality of percussion components, wherein each receiver of the plurality of receivers is configured to detect a strike by the first and/or second stick in the respective radiation striking zone, wherein the at least one base module is configured to project the plurality of radiation striking zones away from the at least one base module; and processing circuitry that generates at least one control signal indicating in which of the plurality of radiation striking zones the strike was detected, wherein the plurality of radiation striking zones expand outwardly from the at least one base module so that at a distance from the at least one base module the plurality of radiation striking zones collectively define a surface area greater than a surface area of the base module.

* * * * *